US008950093B2

(12) United States Patent
Mandelbaum et al.

(10) Patent No.: US 8,950,093 B2
(45) Date of Patent: Feb. 10, 2015

(54) ELECTRONIC GREETING CARDS

(71) Applicant: American Greetings Corporation, Cleveland, OH (US)

(72) Inventors: Josef A. Mandelbaum, Beachwood, OH (US); Rajiv Jain, Monte Sereno, CA (US); Allison Marsh, Olmsted Township, OH (US); Kimberly Bikowski, Avon, OH (US); Cathy Tasse, Westlake, OH (US); David Mayer, Bay Village, OH (US); Eliza DeVogel, Lakewood, OH (US); Katalina Speck, Westlake, OH (US); Mary McClain, Shaker Heights, OH (US); Sharon Bogdanski, Westlake, OH (US); Melinda Leeders, Canton, OH (US); Catherine Gruntman, North Olmsted, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/149,085

(22) Filed: Jan. 7, 2014

(65) Prior Publication Data

US 2014/0137445 A1 May 22, 2014

Related U.S. Application Data

(63) Continuation of application No. 13/095,071, filed on Apr. 27, 2011, which is a continuation-in-part of application No. 12/774,836, filed on May 6, 2010, now Pat. No. 8,312,651, which is a continuation of (Continued)

(51) Int. Cl.

| | |
|---|---|
| ***G09F 27/00*** | (2006.01) |
| ***G09F 1/04*** | (2006.01) |
| ***B42D 15/02*** | (2006.01) |
| ***B42D 15/04*** | (2006.01) |
| ***G09F 1/06*** | (2006.01) |

(52) U.S. Cl.

CPC ..... *G09F 1/04* (2013.01); *B42D 15/022* (2013.01); *B42D 15/042* (2013.01); *B42D 15/045* (2013.01); *G09F 1/06* (2013.01); *G09F 27/00* (2013.01); *B42P 2241/12* (2013.01)

USPC ..... 40/124.03; 40/455; 40/463

(58) Field of Classification Search

CPC .. B42D 15/022; B42D 15/042; B42D 15/045; G09F 27/00; G09F 1/00; G09F 25/00; G09F 19/08; A63H 13/00; G09B 5/062

USPC ..... 40/124.03, 455, 457, 463

See application file for complete search history.

(56) References Cited

U.S. PATENT DOCUMENTS

| | | | | |
|---|---|---|---|---|
| 2006/0134591 | A1* | 6/2006 | Karat | 434/308 |
| 2007/0171278 | A1* | 7/2007 | Chen | 348/61 |

(Continued)

*Primary Examiner* — Casandra Davis

(74) *Attorney, Agent, or Firm* — Christine Flanagan

(57) ABSTRACT

Electronic greeting cards include a greeting card with two or more interconnected panels in combination with a digital multimedia player device which includes an electronic display and an audio output, and circuitry which is operative to receive, store and play digital multimedia files and content. The various greeting card structures cover and encapsulate or otherwise house and adorn the digital multimedia player. Digital files are loaded on to the digital multimedia player by a connection to a network, or directly from a data storage device such as an SD card or USB connection or compact flash which interfaces with a port in the digital multimedia player. Pre-recorded digital multimedia greeting card content is either pre-loaded on a portable data storage device, or selected for purchase and downloaded or transferred for replay by the digital multimedia player of the electronic greeting card.

18 Claims, 24 Drawing Sheets

Related U.S. Application Data application No. 12/126,235, filed on May 23, 2008, now Pat. No. 7,802,386.

(60) Provisional application No. 60/931,836, filed on May 25, 2007.

(56) References Cited

U.S. PATENT DOCUMENTS

2010/0175287 A1* 7/2010 Gupta et al. ..... 40/124.01
2010/0296010 A1* 11/2010 Finnegan ..... 348/794

* cited by examiner

ELECTRONIC GREETING CARDS

RELATED APPLICATIONS

This application is a continuation of U.S. patent application Ser. No. 13/095,071, filed on Apr. 27, 2011, which is a continuation-in-part of U.S. patent application Ser. No. 12/774,836, filed on May 6, 2010 (now U.S. Pat. No. 8,312,651), which is a continuation of U.S. patent application Ser. No. 12/126,235, filed on May 23, 2008 (now U.S. Pat. No. 7,802,386), which claim priority to U.S. Provisional Patent Application No. 60/931,836, filed on May 25, 2007. Each of the above-referenced patent applications is incorporated herein by reference in its entirety.

BACKGROUND OF THE INVENTION

The digital age, created by the advent of personal computers, compact digital electronics and multi-media content has made people very accustom to digital communication and messages. While multi-media content, such as digital images, sound and animation is predominantly distributed and accessed over networks such as television and cable and wireless communication networks, and over the Internet via the world wide web, and received and viewed on various types of monitors, it is increasingly accessed and viewed on smaller and portable devices such as personal digital assistants (PDA), wireless telephones with screen displays, and flat panel displays such as monitors and digital photo frames. Multi-media content is extremely diverse and varied, and provides an infinitely flexible format for expression and communication. It is particularly well suited for sentiment communication and social greetings for all different types of occasions. The ability to use sound and animated or video imagery, in combination with printed matter such as with conventional printed greeting cards significantly enhances the communicative value of social and relational greetings. Although some efforts have been made at combining traditional printed communication and greetings with digital technology and content, the prior art does not include devices or combinations which are sufficiently versatile to accommodate a broad range of content, and which will maintain their utility and entertainment value long after the initial communication.

SUMMARY OF THE INVENTION

The disclosure and related inventions include electronic greeting cards with an integral digital multimedia player receive and play digital multimedia files within a conventional greeting card structure. In a representative embodiment, a greeting card, for example in the form of two or more folded and interconnected panels of paper, plastic or any other suitable material, also includes or incorporates or houses a digital multimedia player which has a display screen and audio output, and suitable electronic circuitry for receiving and playing digital multimedia files which may include graphics and/or audio. Digital multimedia content, which may be selected or created by the sender of the electronic greeting card, or created and provided by a content vendor, is loaded on to the digital multimedia player of the electronic greeting card by any suitable data connection, transfer or storage device, including wired or wireless internet or network connection, or portable data storage device such as USB, flash drive, compact flash or network connection, or portable data storage device such as USB, flash drive, compact flash or smart card via SC/MMC card interface or other data transfer port. With the sender-selected or sender-created digital content thus transferred or loaded on to the electronic greeting card, the digital multimedia player of the greeting card is controllable by the receiver of the card to play and replay the digital content in the context of a conventional two-panel or multiple-panel folded greeting card or other card or packaging constructs. The invention thus combines digital multimedia greeting card content, which has been purchased, selected or created by the sender with a convention greeting card or with any other type or designs of greeting cards or housings or constructs, as further described herein.

The invention enables senders of greeting cards to select, purchase and/or create digital multimedia content which is then directly incorporated into the electronic greeting card for the recipient's enjoyment. The panels of the greeting card work in conjunction with the integral digital multimedia player to convey a combined media message to the recipient. In addition to housing or covering the digital multimedia player, the panels of the greeting card may bear graphics which are printed or handwritten or otherwise applied, and/or other messages or imprints which may or may not correspond to the digital content. The greeting card structure and cooperating digital multimedia player may be fungible, or dedicated and integrally combined. A single type of modular, reusable digital multimedia player may be used and reused with different types of greeting card structures and designs. Accordingly, the owner of such a reusable digital multimedia player configured for integration with a greeting card, may receive different types of greeting cards with different multimedia files from a sender. In a representative manner of use, the recipient loads the multimedia file (as it is received via the portable data storage device or via a network) on to the digital multimedia player, combines the player with the greeting card, and plays and experiences the electronic greeting card message.

In related methods of marketing, sales and distribution, owners of digital multimedia players which are combined with greeting cards to form electronic greeting cards, may be identified in a registry, such as on a personal registry of friends and family to whom greeting cards are sent for different occasions, or in a public or semi-private registry, such as on buddy lists, shared content websites, e-greeting websites with corresponding contact lists, or in-store registries. Purchasers and creators of digital content for greeting cards can thus identify recipients who already possess the digital multimedia player and send them a corresponding greeting card with a digital multimedia file. As noted the digital file can be delivered by a portable data storage device with the greeting card, or transferred via network connection directly to the digital multimedia player.

The electronic greeting cards and/or component parts thereof can be merchandised in at least several different manners. In a retail setting, the component parts of an electronic greeting card, such as the greeting card, the digital multimedia player, the digital media storage device, and pre-stored digital files, can be sold separately or combined. For example, a display of greeting cards which are combinable with a digital multimedia player which may house, protect or cover partially or entirely the digital multimedia player, may be displayed separately on a display rack in a store, or on one or more web pages of an internet website. The corresponding digital multimedia players may be similarly displayed, by type of size, and differentiated for example by size, data storage capacity, display size, housing or case size, shape or color or other features. The portable data storage and transfer devices, such as USBs, flash drive, memory cards, compact flash (CF) or smart cards, may also be displayed, separately or in combination with greeting cards or digital multimedia players, according to type, size, data capacity, color, graphics, shape or other attributes or features.

A further merchandising aspect of the invention is the marketing of pre-recorded digital multimedia greeting card files for specified social events such as a birthday or anniversary. In a retail store or on a website, multimedia files designed for play in a digital multimedia card of an electronic greeting card which may be created and provided by a content provider or vendor, can be viewed or previewed by a purchaser/sender and selected for purchase and transfer or download to a portable storage device or directly to a digital multimedia player, or transmission to a recipient who already owns a digital multimedia device.

A further aspect of the invention is the facilitation of user/sender-created or modified content for the digital file for the digital multimedia player. For example, software which makes available graphics, messages, symbols, icons, sound effects, photo selection and adjustment and other construct and editing functions, can be provided to facilitate user-friendly assembly of a digital file which is properly configured for the digital multimedia player of the electronic greeting card. One representative and non-limiting example is a digital file of a graphical background which matches or corresponds with graphics on the greeting card which is combined with the digital multimedia player. Pre-recorded and/or modifiable digital files can be accessed online at the same website where the other components are offered or in a retail setting, or at different sites.

The disclosure and related inventions thus provide novel electronic greeting cards which combine multimedia messages with conventional and novel physical greeting card formats. The combinations of greeting cards and digital multimedia players are complementary and provide a new type of social expression product in which multimedia messages content is selected, modified or created by the sender and is incorporated directly into a physical greeting card. The physical greeting card works with and augments the operation, form and content of the multimedia player component of the electronic greeting card. The universal configuration of the digital multimedia player or device allows it to be reused continuously in connection with an infinite variety of greeting cards and digital files. The digital content can be played and replayed, periodically or continuously, by the recipient. The four principal components of the electronic greeting card: the greeting card structure, the digital multimedia player, the portable storage device or file transfer means, and the digital content e-files, can be merchandised separately or together in retail stores or online.

In one aspect of the disclosure, there is provided an electronic greeting card which includes a multimedia player device having a generally planar case with a front cover and a back cover which is generally parallel with the front cover, and a perimeter wall which extends between major planar areas of the front cover, and a perimeter wall which extends between major planar areas of the front cover and the back cover, the case containing: a display which is visible through the front cover, a speaker which is audible through the case, a battery power source, an SD card interface for receiving an SD card through an opening in the case, and circuitry powered by the battery power source and which operatively connects the SD card interface with the display and the speaker to process digital multimedia data on an SD card in the SD card interface for display of static or moving images represented by the digital multimedia data on the display and playing of audio signals represented by the digital multimedia data on the speaker, the circuitry further operatively connected to control keys accessible from an exterior of the case, the control keys operative to control power to the circuitry from the battery power source, and operation and display of a menu on the display for controlling displaying and playing of digital multimedia data by the device; a card which fits with the device, the card having a first panel and a second panel which are connected by a fold hinge and generally aligned with the front cover of the device, the first panel dimensioned to cover substantially the entire major planar area of the front cover, and the second panel dimensioned to substantially cover the major planar area of the front cover around the display, whereby the display is visible by movement of the first panel of the card about the hinge to reveal the second panel through which the display is visible.

These and other aspects of the disclosure and related inventions are further described herein with reference to the accompanying drawing figures.

DETAILED DESCRIPTION OF PREFERRED AND ALTERNATE EMBODIMENTS

Figure 1:
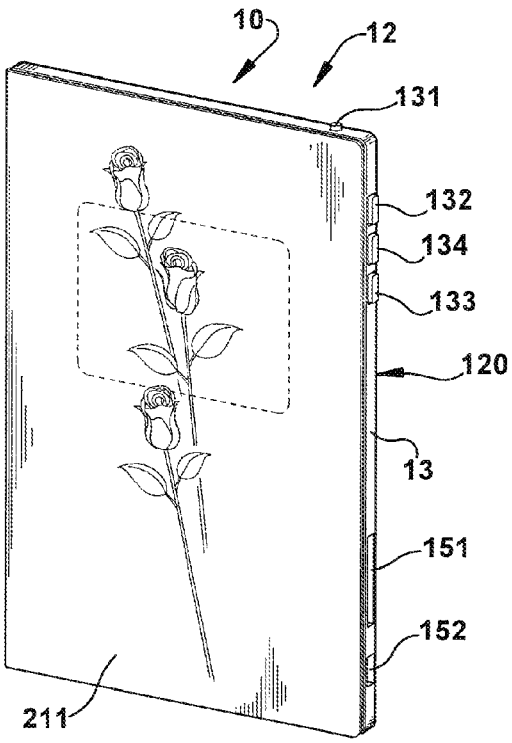
FIGS. 1 and 2 are perspective views of a first representative embodiment of an electronic greeting card of the disclosure.

As shown in each of the Figures, an electronic greeting card, indicated generally at 10, includes a multimedia player or multimedia player device 12 (also referred to herein as "device 12") which is operative to display and play, with images and audio, multimedia content including graphics, photographs, video and sounds and music. The device 12 is illustrated by itself in FIGS. 3 and 4, in connection with a card C in FIG. 3 and with a stand S in FIG. 4. A representative form of the device 12 is a generally planar and rectangular case 120 having a front cover 121 and a back cover 122 which preferably has a scale and size which is easily handled and shipped, and which is generally congruent with the various sizes of printed greeting cards and other paper or panel based structures, but which can also be made larger or smaller as desired. Some representative dimensions of the case 120 of the device 12, which are exemplary only, are a width in a range of approximately 3 to 5 inches, a height in a range of approximately 5 to 7 inches, and a thickness of a perimeter edge walls 13 ("perimeter wall") (as measured from the front cover 121 to the back cover 122 and which extends between major planar surfaces of the front cover 121 and the back cover 122 on the four sides of the generally rectangular case 120) in a range of approximately ¼ of one inch to ⅜ of one inch, or preferably less than 5 mm. Other dimensions outside of theses exemplary ranges are within the scope of the disclosure and related inventions. The total weight of the device is preferably less than 100 gm. As used herein, the descriptions of "front" and "back" with reference to the covers 121, 122 are for relative distinction only.

Figure 7A:
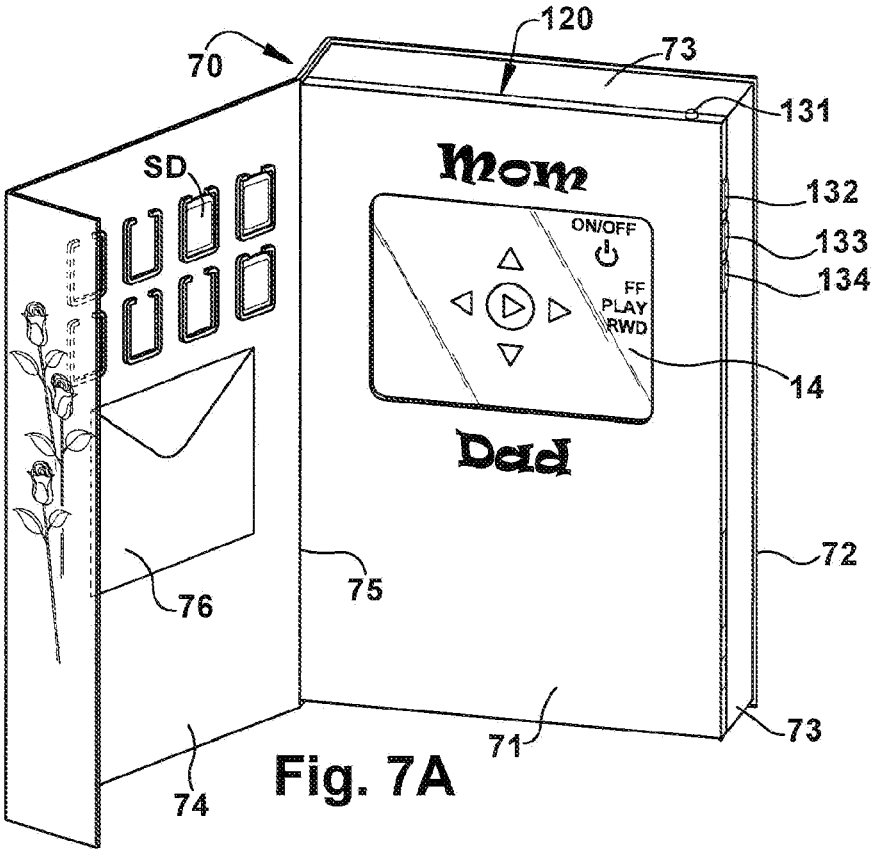
FIG. 7A is a perspective view of a fifth representative embodiment of an electronic greeting card of the disclosure.

An opening 1211 in the front cover 121 is for a display 14, such as a flat panel display such as a liquid crystal display or any other type of image display device, capable of display of static and/or video images. One example of a suitable display 14 for the device 12 is a liquid crystal display (LCD), such as a QVGA TFT LCD with 320×240 pixels, 16.7M colors and with a 3.5 inch diagonal dimension. Other sizes and types of displays may be used in accordance with the disclosure and inventions, including but not limited to STN LCD, TFT LCD, CSTN, OLED/PLED (organic polymer light emitting diodes), FED (field emission display) or SED (surface-conduction electron-emitter display). Video display formats may include MPEG4, MJPEG, or H263. One or more filters or coatings may also be used in connection with the display to enhance clarity and viewability in all light conditions. Touch screen technology may also be employed for operation of the device 12 via the display 14, for example via a graphical user interface as schematically depicted in FIG. 7A.

Figure 2:
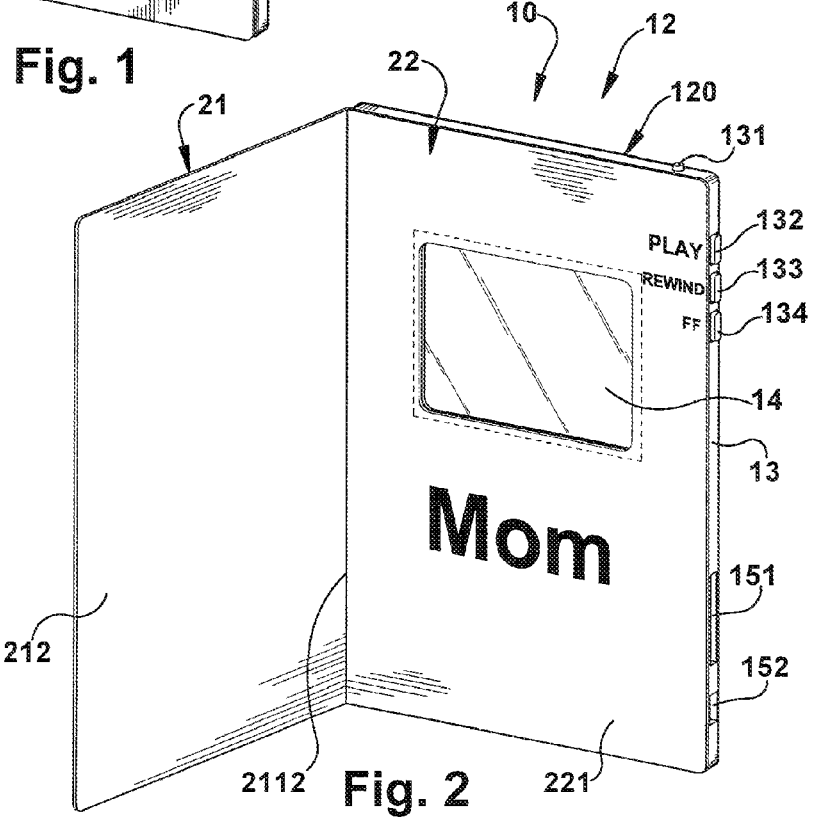
Figure 30:
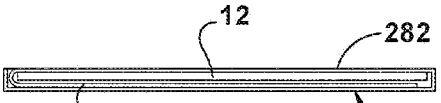
Figure 31:
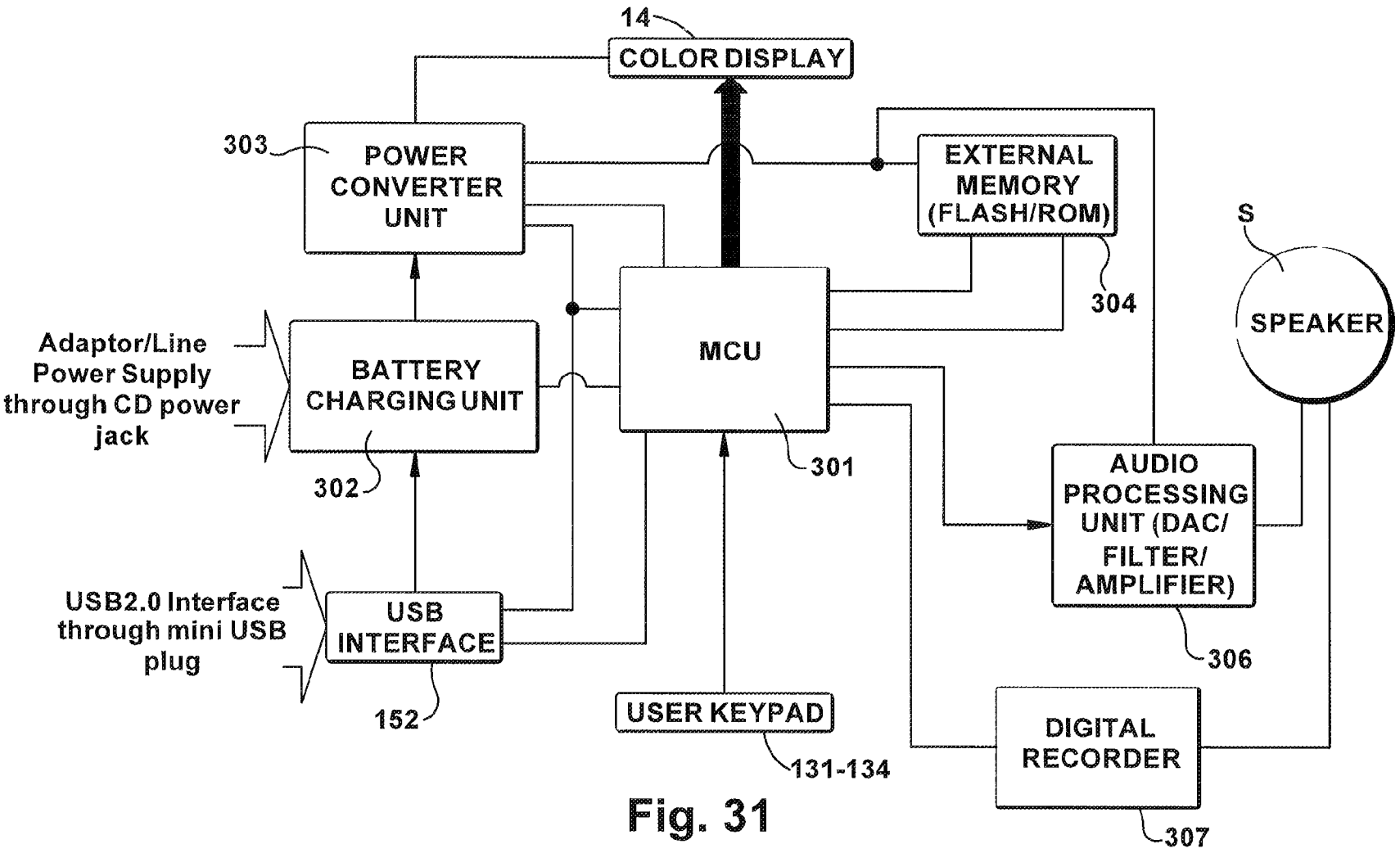
Figure 32:
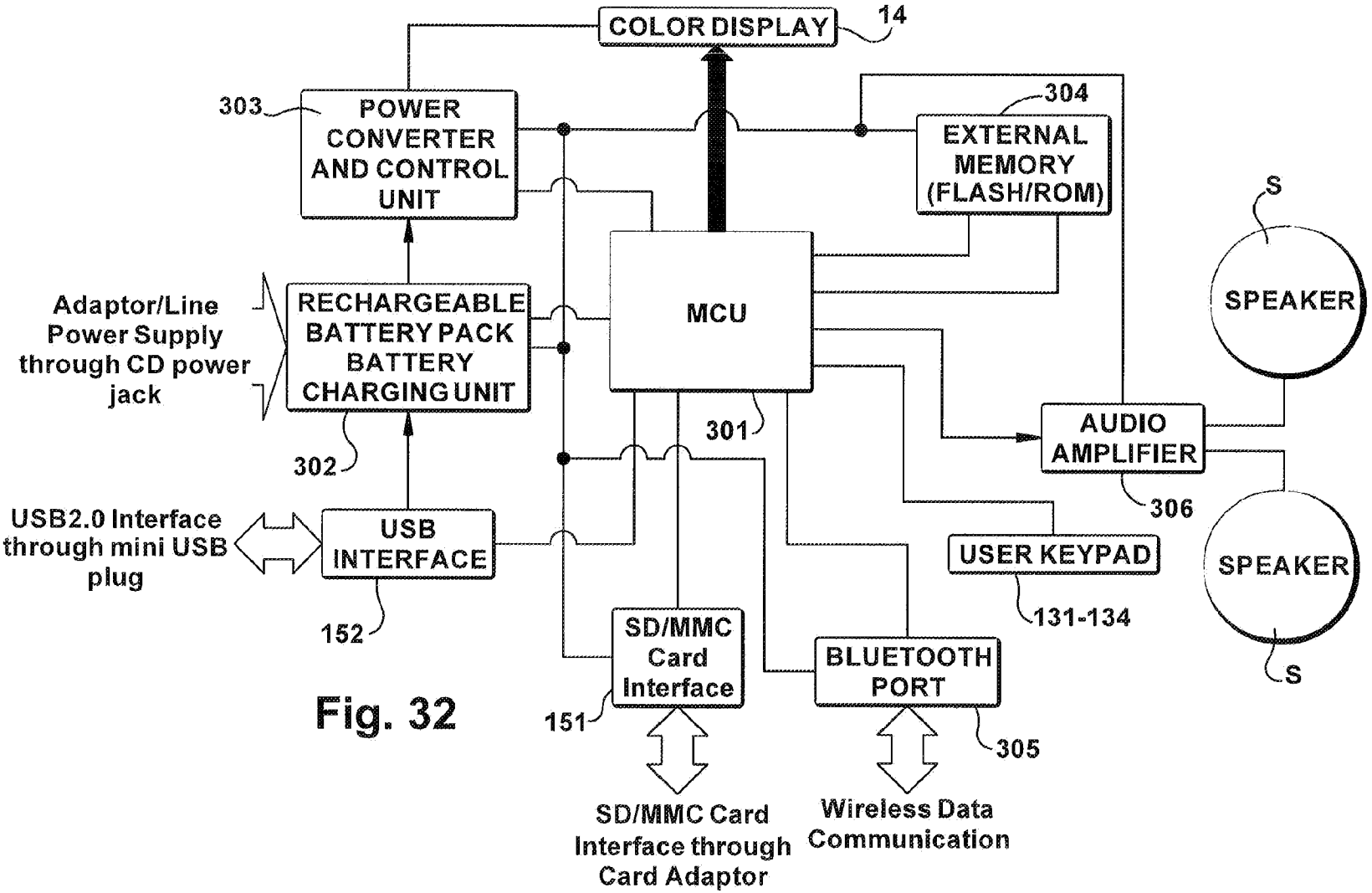

As illustrated externally in FIGS. 1-30, and internal electronic components further schematically illustrated in FIGS. 31 and 32, the device 12 includes a power on/off key 131 (e.g. as part of the USER KEYPAD 131-134 or "control keys"), which may be in one form a momentary contact switch mounted for access through either the front cover 121 or back cover 122 or at a perimeter of the case as shown in FIGS. 1 and 2. Other controls or functions of the control keys include a scroll up key 132, a scroll down key 133, and a menu-select key 134, each of which may also be located in either the front cover 121 or back cover 122 or at a perimeter of the case. As further described, the power on/off key 131 controls power to device circuitry which in part generates a display upon display 14, part of which may include an operational menu which is accessed and used via the menu/select key 134 and the scroll keys 132, 133 which may further function as up and down volume controls. Other control functions may include pause, fast forward and rewind for video, or "go-back" for frame sequencing. Auto-shut-off, for example, after a programmed dormant period may also be included in the control circuitry. These control functions of the control keys may be indicated on the key buttons or on one of the card panels, or on a menu displayed on the display 14.

Also incorporated into the case and accessible through the covers, and more particularly accessible through the perimeter wall 13 of the case 120 is an SD card interface in the form of an SD card slot 151, such as for a "mini SD card" or MMC card type portable digital data storage device and a USB port 152 also preferably located in the perimeter wall 13 of the case 120, such as a "mini USB" type B slot for digital data transfer and battery charge via connection to an AC or DC power source, as may be provide through another device such as a personal computer. Suitable accessories which may be sold with or otherwise provided with the device 12 and/or electronic greeting card 10 include a battery charger which is connected to the device through the USB port 152, a USB cable also connected through the USB port 12 for transfer of data from a source such as a computer or the Internet to the device 12 and also for battery charging, and an SD or MMC card, such as a mini SD card compatible to version 1.0 for external memory support and digital data transfer. Representative file formats for audio data include AMR and MP3, for video MPEG4, and for images BMP, JPG and GIF.

The device 12 further includes the use of other types and forms of digital data storage devices, including memory cards, compact flash memory cards ("compact flash" or "CF"), secure digital (SD), and secure digital high capacity (SDHC). Compact flash is a type of solid state memory device which retains data without power. It is typically in the form of a small (nominally 1" by 1") planar card or housing which contains one or more solid state memory chips and a memory controller. Secure digital (SD) cards are relatively smaller in size than CF cards, and are presently limited to 2 GB data capacity. The use SD cards for digital contents also enables the use of built-in digital rights management (DRM) and cryptographic features for protection against unauthorized copying.

Because CF cards can be used directly with the device port, or as an IDE hard drive with a passive adapter, and with a reader, with any number of common ports like USB, they are highly adaptable for interface with a wide variety of digital devices beyond the most common current use in digital cameras, including but not limited to desktop computers, laptop computers, cell phones, PDAs, television, digital television, DVD players, audio systems, video game systems, car stereos, digital audio players, MP3 players, digital audio photo frames and any type of memory device interface. The very small size of memory cards and compact flash cards makes them ideal for use with the device 12 and in combination with accompanying greeting cards or other types of printed cards as further described.

The device 12 may include a lower power micro-controller 301 with flash memory software 304, non-volatile RAM for digital data storage, and LCD controller and image buffer, and one or more communication ports such as USB 152, wireless USB, IrDA, Bluetooth or Wi-Fi 305.

When the device 12 is turned on by operation of the power on/off key 131, by for example holding the power on/off key 131 for 3-4 seconds, power is delivered to the microprocessor control unit (MCU) 301 and to the display 14 and an introductory message or indicator is displayed thereon. To turn off the device, the power on/off key 131 is similarly pressed for a period of time such as 3 or 4 seconds. The device 12 may alternatively be equipped with an auto-power-up feature activated by opening of the card, as further described. Upon power-up, an operation menu may appear on the display 14, or the device may be configured to immediately play a file which is stored on the SD card or in resident memory.

The device 12 preferably operates on an internal power source, such as a battery 302 with a battery charging unit (rechargeable battery pack) power converter and control unit 303, and preferably a lithium polymer re-chargeable battery such as 3.7V, 1200 mAh, chargeable by USB charger inserted into the mini USB charger connected to an AC power supply via the USB port 152, or by USB cable connected to another powered device such as a personal computer via the USB port 152.

The USB port 152 is an interface which is compatible to the USB 2.0 specification, by which files transferred to the device 12 can be stored in internal memory or to the external SD card. To transfer data or files from a source (e.g., PC or Internet) to the device 12, a USB cable is connected from the source to the USB port 152. When connected to a suitably programmed and configured computer, the computer will recognize the connection to the device 12 and will enable the transfer of selected files from the computer to the device 12. Also, files already present in the memory of the device 12 may be deleted.

The device 12 further includes at least one audio speaker S, such a mono audio speaker S, with a sound opening in at least one of the front or back cover 121, 122, or both. The speaker and audio driver circuitry, including audio amplifier and processing (DAC/filter/amplifier) 306 is configured to generate sound levels which are clearly audible within a distance range of approximately one or two meters, or otherwise configured for hand-held communication or room ambient operation and broadcasting. The speaker volume is adjustable up and down by operation of the up and down scroll keys 132, 133. The speaker may be configured for 8 bit or 4 bit ADPCM native audio, or MP3, AMR or WAV audio formats.

The case 120 of the device 12 thus contains a display 14 which is visible through an opening 1211 in the front cover 121 (or alternatively through the back cover 122), a speaker which is audible through the case, a battery power source 302, an SD card interface for receiving an SD card through an opening in the case, and circuitry powered by the battery power source and which operatively connects the SD card interface (SD card slot 151) with the display and the speaker to process digital multimedia data on an SD card in the SD card interface for display of static or moving images represented by the digital multimedia data on the display and playing of audio signals represented by the digital multimedia data on the speaker, the circuitry further operatively connected to control keys accessible from an exterior of the case, the control keys operative to control power to the circuitry from the battery power source, and operation and display of a menu of the display for controlling displaying and playing of digital multimedia data by the device 12. The microprocessor 301 may include firmware or otherwise be programmed to perform the described multimedia functions and to enhance the quality of the content, such as sound filtration, pixel density and image compression and scaling for optimal audio and visual performance.

Figure 3:
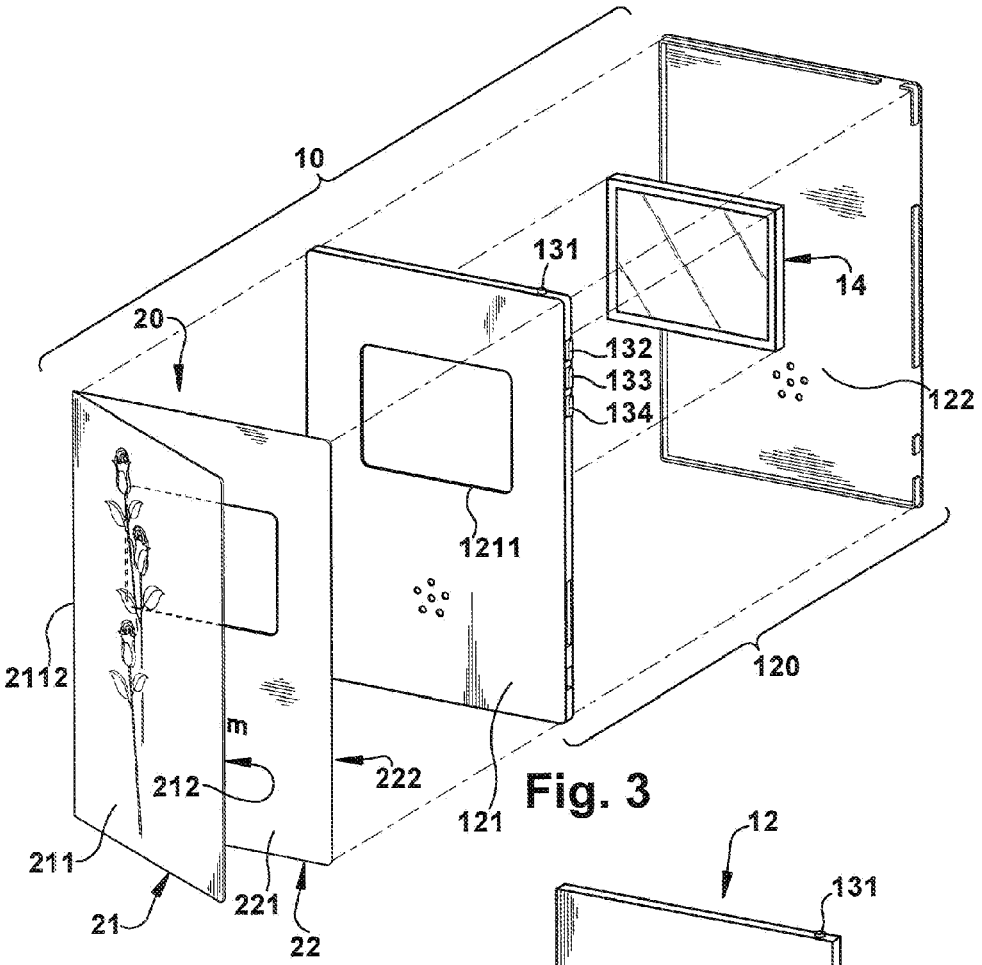
FIG. 3 is an assembly view of the first representative embodiment shown in FIGS. 1 and 2.

An additional feature of the device 12 is a digital recorded 307, as represented in FIG. 31, which may be operatively connected to the microprocessor control unit 301, or alternatively connected directly to one or more speakers S. The digital recorder 307 may be operated via menu generated by the MCU 301 or by an external control. The digital recorder 307 has recording and playback functionality for operation by a sender or recipient of the electronic greeting card 10, to provide digital recording and playback or audio messages or other information in conjunction with or complimentary to the digital content of the device 12. FIGS. 1, 2 and 3 illustrate a first representative embodiment of the electronic greeting card 10 of the disclosure, wherein the multimedia player device 12 is combined with a multiple panel construct, such as an enclosure, cover or greeting card, generally indicated at 20, and referred to alternatively herein as a "card", "greeting card", "cover", "sleeve" or "paper construct", which includes multiple panels which fit in various ways with the device 12. IN the embodiment of FIGS. 1 and 2, the card 20 has two panels 21 and 22 joined along a fold line or hinge 2112. The first panel 21 has a first side 211 which serves as a first page or cover page ("cover page" or "first page" or "page one" 211), and a second side 212 which serves as a second page ("second page" or "page two" 212). The second panel 22 has a first side 221 which serve as a third page ("third page or "page three" 221) which is opposed to the second page, and a second side 222 which is attached to the front cover 121 of the device 12. By this construction, the card 20 serves as both a functional cover for the device 12, and a message delivery medium, which communicates together with the multimedia content which is played by the device 12. For example, the cover page 211 of the card may bear an occasion identifier, such as "Happy Birthday", and complimentary graphics. The second page 212, although often left blank in conventional greeting cards, may also bear any type of printed matter, graphics or text. The third page 221 fits over the front cover 121 of the device and therefore has an opening 2211 through which the display 13 of the device 12 is visible.

As shown in FIG. 2, the control keys remain visible and accessible at the perimeter 13 of the device 12 which is not covered by the card 20. The control keys 1310134 and SD card slot 151 and USB port 152, being located in the perimeter wall 13 of the case 120 are located proximate to and beyond edges of the panels 21, 22 of the card so that the panels of the card do not cover, extend over, or otherwise obstruct or interfere with the control keys or SD card slot or USB port. This is a preferred configuration for the electronic greeting card of the disclosure, because it enables conventional paper greeting card formats in combination with the digital multimedia player and does not interfere with or hinder the operation of the digital multimedia player device. The second side 222 of the second panel 22 can be attached to the front cover 121 of the device 12 by adhesive or mechanical attachment, either permanently or removably.

Figure 4:
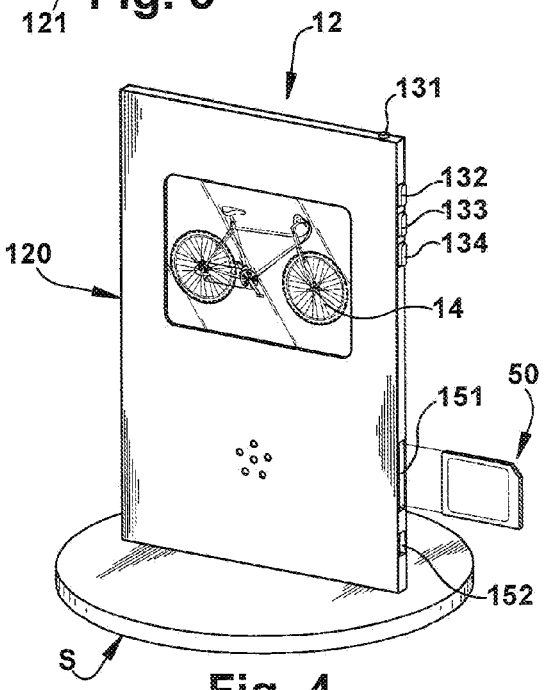
FIG. 4 is a perspective view of a second representative embodiment of an electronic greeting card of the disclosure.

Also, the front cover 121 and/or back cover 122 of the device may be colored or adorned in a manner which is coordinated with the color and graphics of the card 20. The aesthetics of the device case as formed by the front cover 121 and back cover 122 are preferably such that the device 12 can also or alternatively used and displayed by itself, as shown in FIG. 4, for example supported by a stand S or simply as an entertainment device by itself.

As used and described herein, the term "card" in reference to the various card constructs which fit with the device 12, can be in a wide variety of forms, with a common attribute of having at least one panel which fits with the device 12, and more particularly with the case 120 of the device 12 and leaves the display 14 of the device 12 visible and in concert with the one or panels or pages or constructs of the card 20. Another common structural feature of the various embodiments of the card 20 and of the electronic greeting card 10 is access to the control keys 131-134 and ports 151-152 for control and operation by the sender and receiver, that the control keys 131-134, and the SD card slot 151 and USB port 152 are located in the perimeter wall 13 of the device 12, accessible through one or more side walls or perimeter 13 of the device, and accessible proximate to and beyond edges and panels of the card 20.

Figure 5:
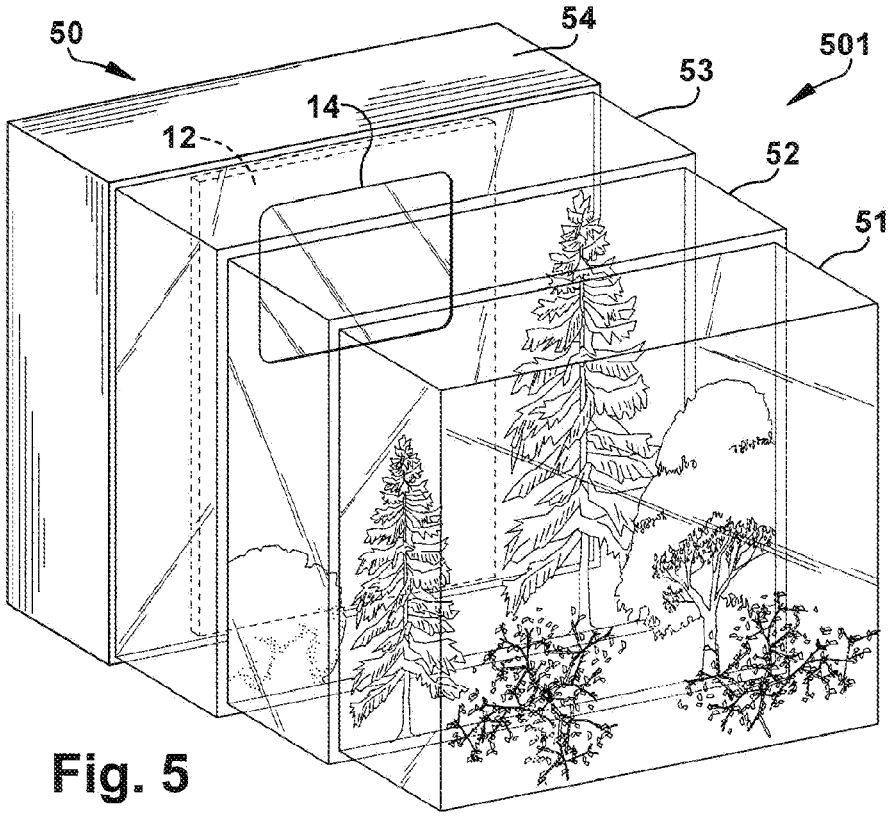
FIG. 5 is a perspective view of a third representative embodiment of an electronic greeting card of the disclosure.

FIG. 5 illustrates an embodiment of an electronic greeting card 50 wherein the paper construct or card is in the form of a multi-level pop-out construct, generally indicated at 501, with multiple stages or frames 51, 52, 53 which extend from a frame or box-like structure 54 in which the device 12 is contained. There may be objects or construct or cut-outs in each of the frames, beyond which the display 14 is visible through an opening in a front panel of the box 54 in which the device 12 is contained.

Figure 6:
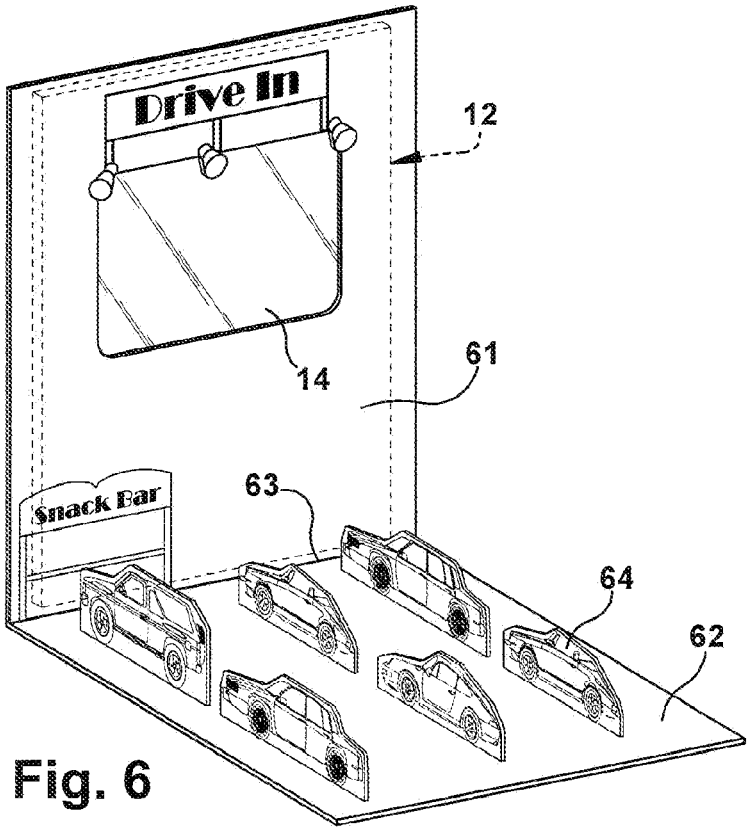
FIG. 6 is a perspective view of a fourth representative embodiment of an electronic greeting card of the disclosure.

FIG. 6 illustrates another embodiment of a three0dimensional card construction in which card 60 has a first panel 61 which fits over the front cover 121 of the device 12, and a second panel 62 and connected by a fold line or hinge 63 at a bottom edge of panel 61. One or more objects 64 are configured to project upward from panel 62 to create a three-dimensional scene which corresponds with the graphics or ornamentation on panel 61. The display 14 of the device 12 is visible through a correspondingly sized opening in panel 61. Although control keys and ports of the device may be covered from the front side by panel 61, they are nonetheless still accessible from behind panel 61.

FIG. 7A illustrates another embodiment of an electronic greeting card 70 of the disclosure which is generally in the form of a book or card sleeve which fits over or around the device 12, with opposing panels 71 and 72 forming a receptacle for the device 12. Panels 71 and 72 may be spaced apart to create a volume which is just sufficient for the device 12, or which is greater than the volume required for device 12, so that the card 70 has the general appearance of a book, with side panels 73 filling the space between panels 71 and 72, and through which the control keys 131-134 are accessible. Panel 72 constitutes a "third panel" of the card. An opening in panel 71 reveals display 14 of the device 12. A cover panel 74 is attached to panel 71 along fold line or hinge 75. An interior side of cover panel 74, or "page two" may be configured to carry complimentary products such as an envelope 76, and one or more SD cards which may be pre-loaded with additional multimedia content and/or with additional storage space. One of the side panels 73 may be removed or removable or openable to allow for installation of the device 12 within the card enclosure, and access for example to the SD card slot 151 and/or USB port 152.

Figure 7B:
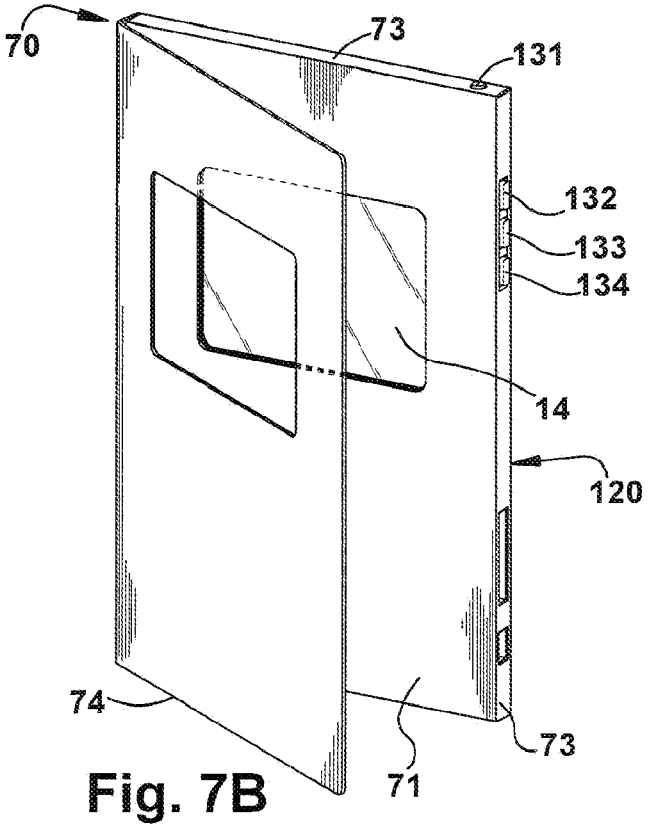
FIG. 7B is a perspective view of a variation of the fifth representative embodiment of an electronic greeting card of the disclosure.

FIG. 7B illustrates a variation of the embodiment of FIG. 7A, wherein the opposing panels 71 72 and side panels 73 enclose or encapsulate the device 12 in a somewhat compact manner which maintains the thickness dimension of the electronic greeting card 10 while protecting the device 12, and allowing access to the control keys 131-134. The opening in panel 71 is similarly dimensioned for viewing of the display 14 through panel 71, and the cover panel 74 provides the first two "pages" of the greeting card and a protective cover for the display 14.

Figure 8:
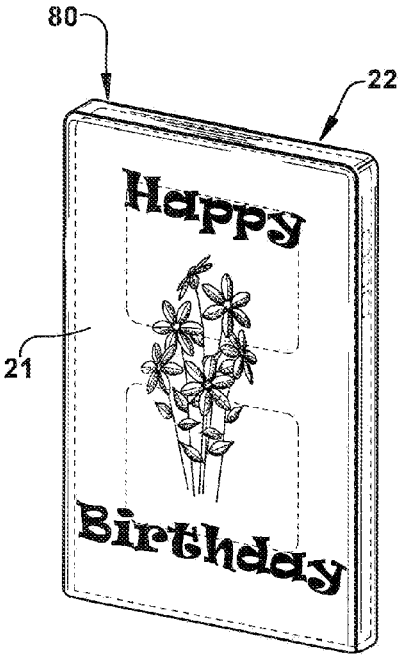
FIGS. 8 and 9 are perspective views of a sixth representative embodiment of an electronic greeting card of the disclosure.
Figure 9:
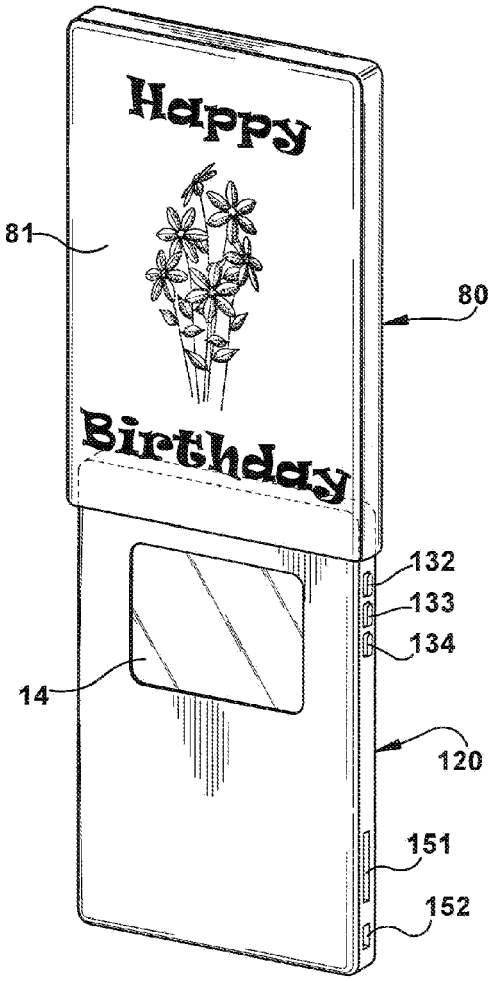

FIGS. 8 and 9 illustrate a sleeve 80 which is dimensioned to fit over the exterior of the device 12. The sleeve 80 functions as a message carrying greeting and a protective cover for the device 12. Openings can be formed in the sleeve 80 for access to the control keys 131-134 on the device. Alternatively, an opening could be formed in a front panel 81 of the sleeve 80 through which the display 14 is visible. Sleeves 80 can be provide as separate card products which are selected by the consumer for combining with the device 12.

Figure 10:
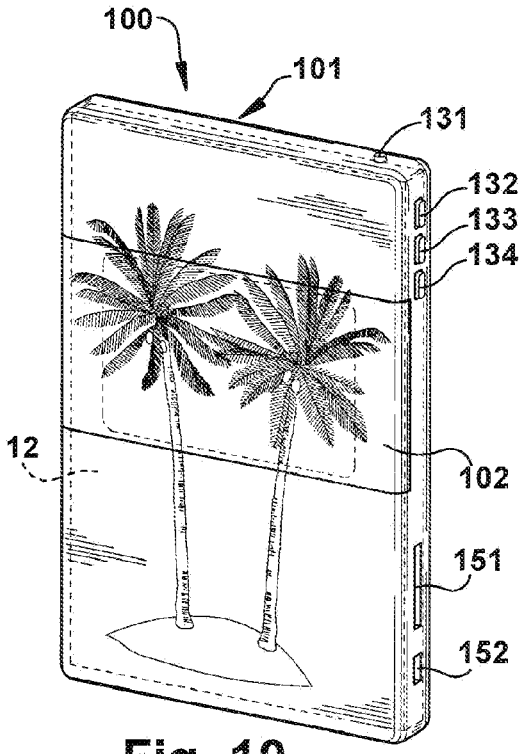
FIGS. 10 and 11 are perspective views of a seventh representative embodiment of an electronic greeting card of the disclosure.
Figure 11:
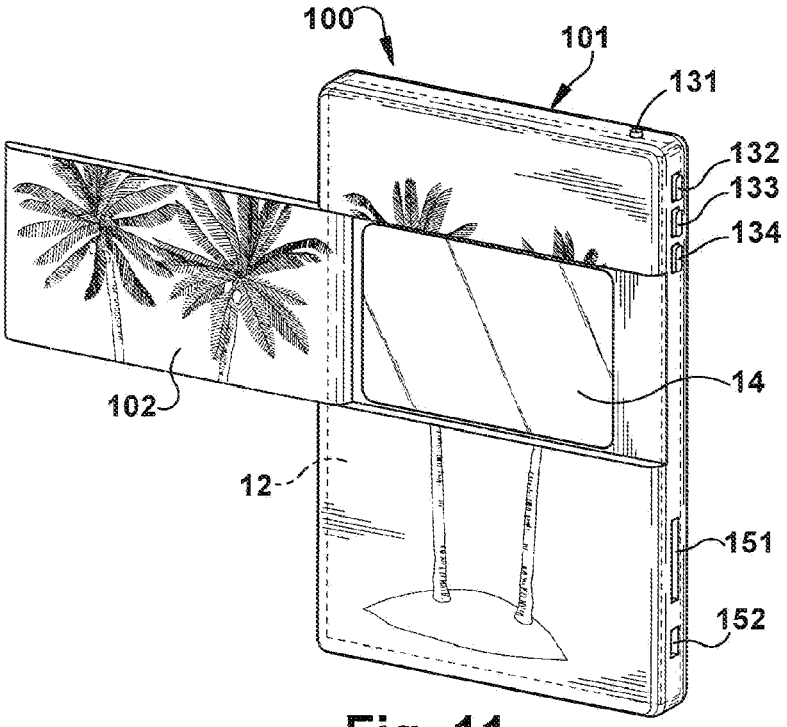
Figure 12:
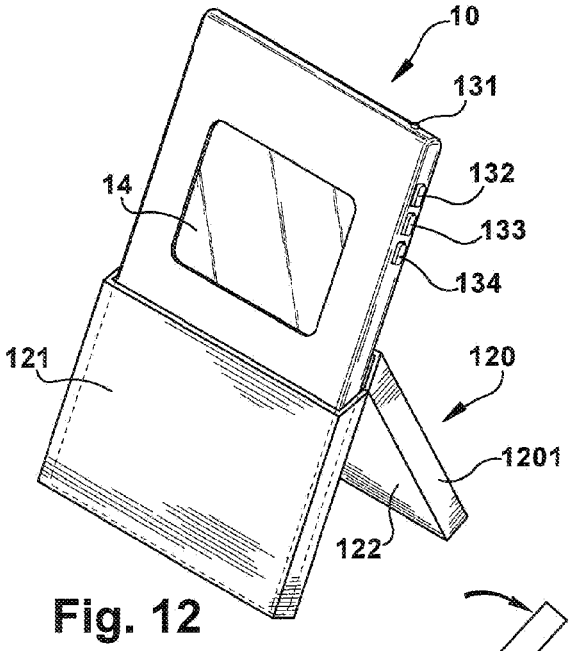
FIGS. 12-15 are perspective views of an eighth representative embodiment of an electronic greeting card of the disclosure.
Figure 13:
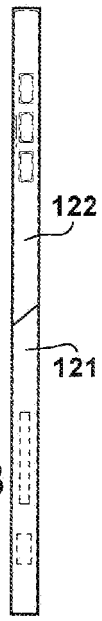
Figure 14:
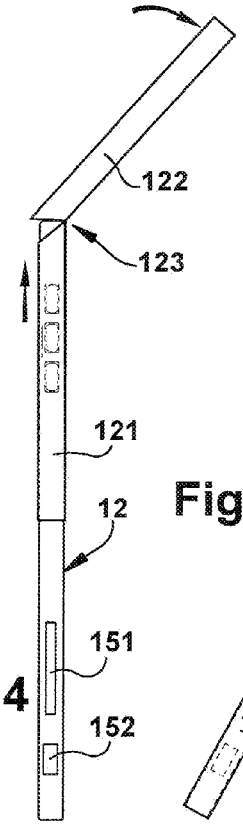
Figure 15:
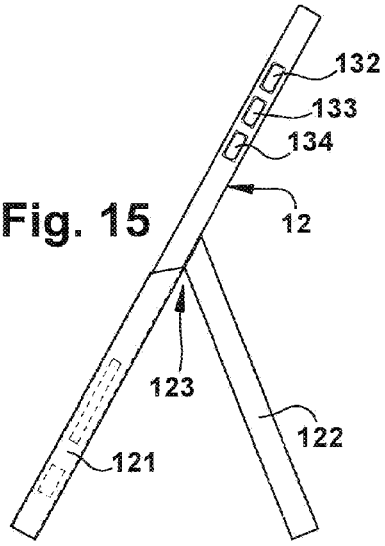

FIGS. 10 and 11 illustrate another embodiment of an electronic greeting card 100 wherein the case 120 of the device 12 may be made of paper or fiber board, and can alternatively be made of molded plastic, and which has a sliding door 102, for example in the front cover 121 for revealing the display 14 of the device 12. Alternatively, the sliding door 102 may be incorporated in the front cover 121. In the embodiment where there is no card or card-like structure in combination with the device 12, the case 120 of the device may be printed or silk-screen or otherwise adorned to form the electronic greeting card.

FIGS. 12-15 illustrate another embodiment of a sleeve type card 120 which fits with the device 12. The card 120 has a lower section 121, which may have a closed lower end or be left open. The lower section generally covers the lower half of the device 12 and ports 151, 152. An upper section 122 generally covers the upper half of the device 12, the control keys 131-134 and the display 14. The upper section 122 may be completely separate (not connected) with respect to the lower section 121, or adjoined together along a fold line or hinge 123. If joined by hinge 123, the bottom of the lower section 121 is left open so that the entire card 120 can slide with respect to the device, and the upper section 122 can be folded back along fold line hinge 123 to serve as a frame display support for the device 12, and to reveal the display 14 and the control keys 131-134. Alternatively, an opening can be formed in the front panel of the upper section 122 through which the display 14 is visible. The upper section 122 and lower section 121 are formed with first and second parallel panels which are spaced apart and connected together by side walls 1201. Openings can be made in the side walls 1201 for access to the control keys 131-134 and SD card slot 151 and USB port 152. Sleeve type cards 120 can be merchandised separate from the device and selected by consumers by occasion or theme and then combined with the device 12.

Figure 16:
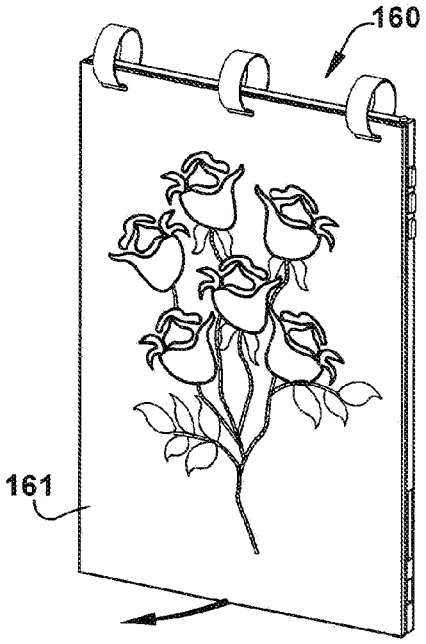
FIGS. 16-18 are perspective views of a ninth representative embodiment of an electronic greeting card of the disclosure.
Figure 17:
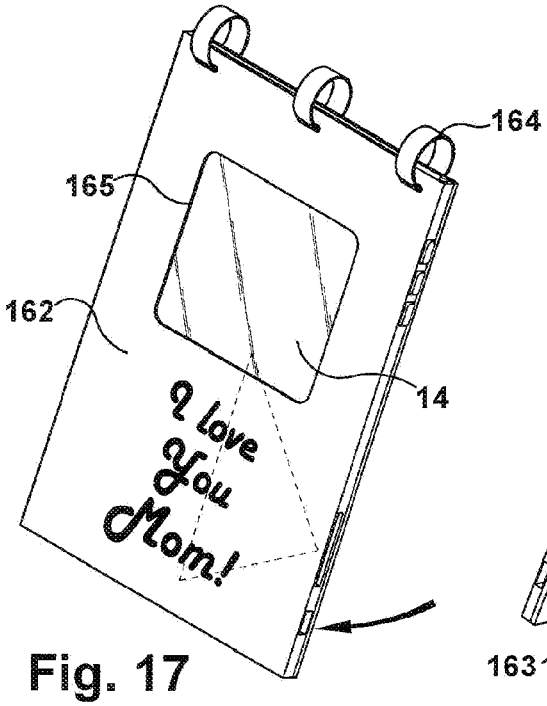
Figure 18:
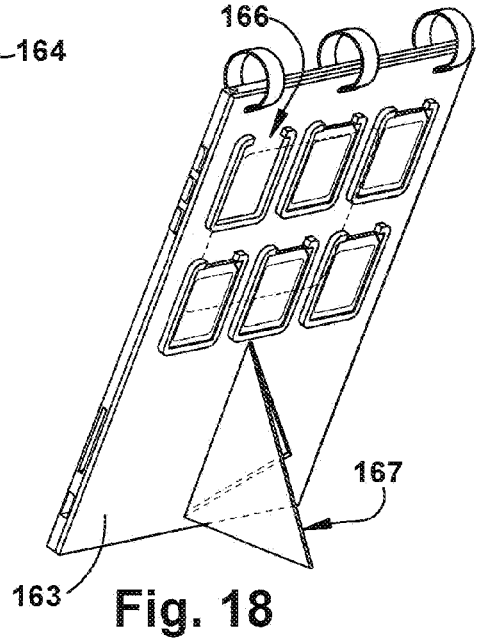

FIGS. 16-18 illustrate an alternate embodiment of an electronic greeting card 160 in an flip board or flip chart type configuration, wherein a cover panel 161, the device 12, and one or more internal or inside panels 162 and a back panel 163 are attached by one or more rings 164 or any other type of fastener or connection which allows relative movement of the panels relative to the device 12. An inside panel 162 may have an opening 165 for the display 14 of the device 12. A back panel 163 may include slots 166 for additional SD cards, and an easel stand 167 for display of the electronic greeting card 160 with any one of the cover or internal panels displayed.

Figure 19:
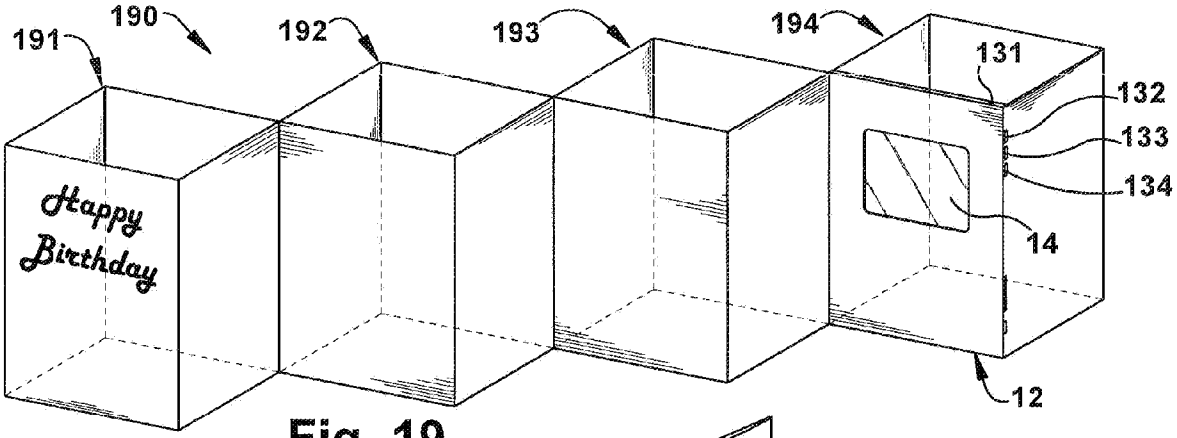
FIGS. 19-20 are perspective views of a tenth representative embodiment of an electronic greeting card of the disclosure.

FIG. 19 illustrates an alternate embodiment of an electronic greeting card 190 which is in the form of a three-dimensional accordion honeycomb Z-fold configuration wherein multiple sections 191, 192, 193, 194, etc. are formed as symmetrical gate-folded panels as polygonal boxes, with four panels in each section. The exterior sides of any of the panels can be printed or otherwise adorned with graphics and messages. The device 12 can be incorporated into any one of the sections, such as section 194 as illustrated, internal to the four panels of that section with an opening 195 through which the display 14 is visible, and the control keys 131-134 projecting or accessible through an adjacent panel. The device 12 may be secured to the interior of any one of the panels of a section, or held within a sleeve or pocket on an interior side of any one of the panels. The card 190 can be folded substantially flat along the hinge lines as illustrated between each of the panels of each of the sections.

Figure 20:
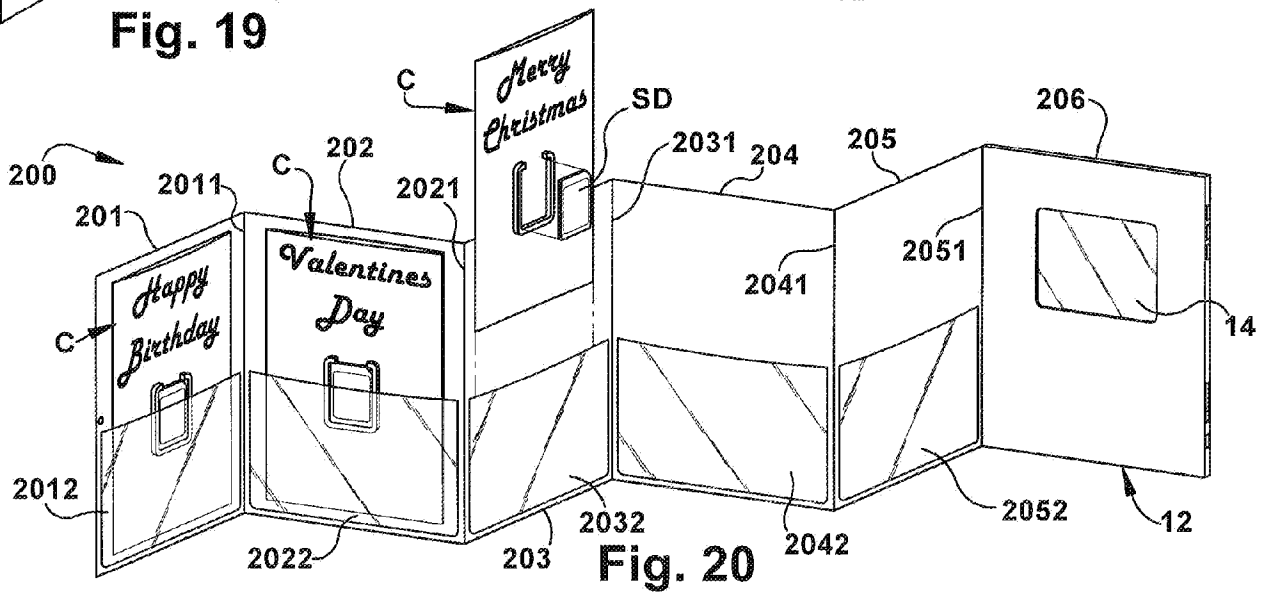

FIG. 20 illustrates an electronic greeting card keepsake package 200 which is in the configuration of a multiple panel accordion folded card, with the successive panels 201-206 connected together along respective hinge folds 2011-2051. In this particular embodiment, five of the panels 201-205 are configured with sleeves or pockets 2012-2052 which can hold a separate card C, such as a greeting card or postcard which also carriers an SD card for use with the device 12 which is attached to panel 206. Each of the cards C may be for a different event or occasion, such as "Birthday" or "Merry Christmas" with corresponding content on the accompanying SD card. The keepsake package 200 thus provides a way for the recipient of multiple electronic greetings to categorize and store the SD cards for different events and occasions for playing and re-playing on the device 12. Also, in a variation the device 12 may be removably attached to panel 206, and combined with any of the cards C selected from any one of the pockets 2012-2052.

Figure 21:
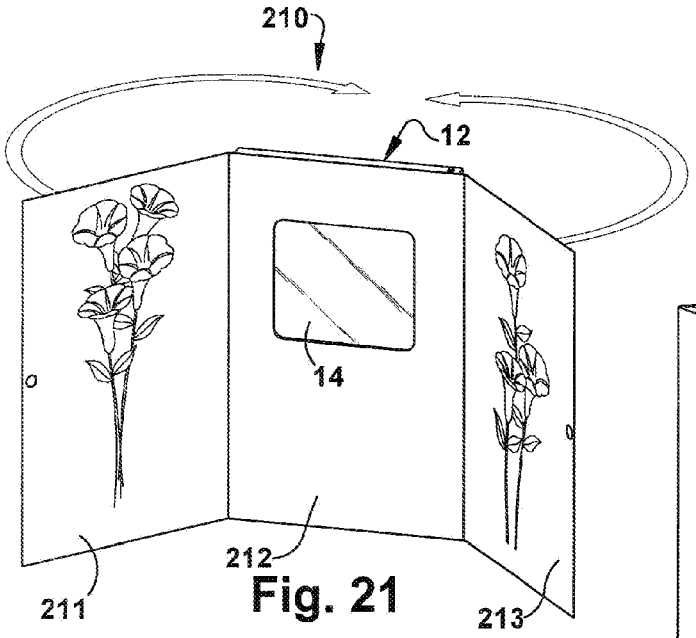
FIGS. 21-24 are perspective views of an eleventh representative embodiment of an electronic greeting card of the disclosure.
Figure 22:
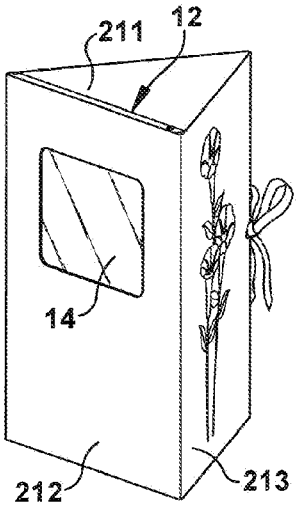
Figure 23:
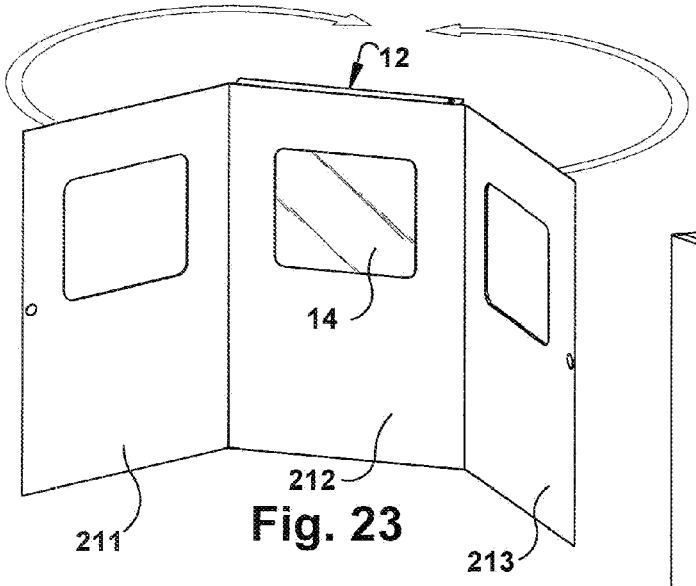
Figure 24:
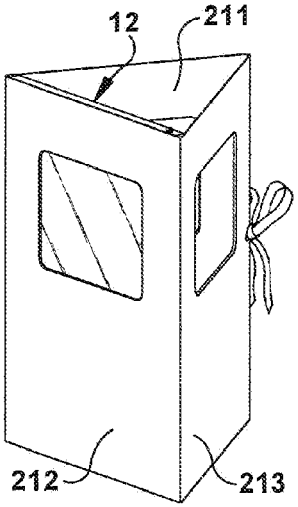

FIGS. 21-24 illustrate variations of a three-panel gate folded configuration electronic greeting card 210. Panels 211 and 213 are connected by respective hinge folds 2111 and 2131 to a central panel 212 which serves as a cover for the device 12. The side panels 211 and 213 can be opened to reveal central panel 212, and the display 14 visible therethrough, and folded back (and optionally tied) to form a triangular base. Openings can be made in side panel 213 for access to the control keys. As shown in FIGS. 21 and 22, only the central panel 212 may have an opening which corresponds with the location of the display 14, or one or both of the side panels 211, 213 may have an opening which corresponds with the location for the display 14 when in the folded configuration.

Figure 25:
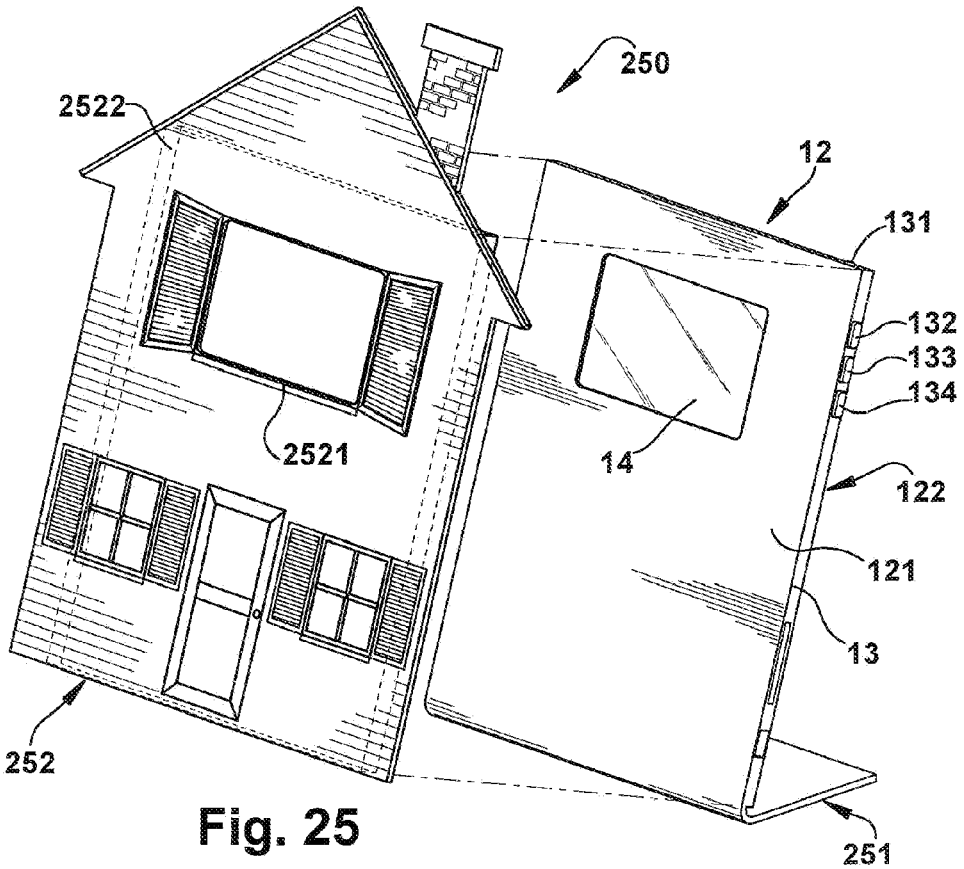
FIGS. 25 and 26 are perspective views of a twelfth representative embodiment of an electronic greeting card of the disclosure.
Figure 26:
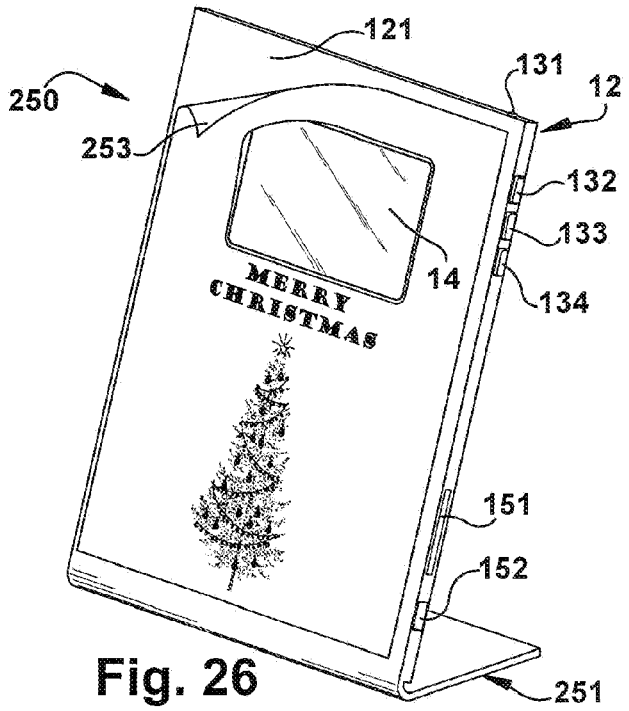

FIGS. 25 and 26 illustrate an electronic greeting card 250 wherein the device 12 is integrally formed with or attached to a base 251 which supports the device 12 in a generally vertical orientation with the display 14 facing forward. The base 251 may be integral with the front cover 121 or otherwise attached to the front cover 121 or to the back cover 122. A decorative overlay 252 is provided for attachment to or positioning directly over the front cover 121, with an opening 2521 through which the display 14 is visible. The overlay 252 may optionally have rearward projecting walls 2522 which fit over the side walls 13 of the device 12, or may be a substantially planar structure which is affixed directly to the planar surface of the front cover 121, for example by adhesive, such as light tack temporary adhesive or permanent adhesive, hook and loop type fasteners, snaps, magnetic or any other type of suitable fastener or mounting system. The card or overlay 252 may extend beyond the edges or dimensions of the device 12.

FIG. 26 illustrates a variation on the electronic greeting card 250 wherein a card or overlay 253 is applied to the exterior surface of the front cover 121, with an opening 2531 for the display 14. The card or overly 253 in this example does not extend beyond or around the edges of the front cover 121, and therefore does not cover the control keys 131-134 or the ports 151-152. The card or overlay 253 is preferably removably secured to the front cover 121, for example by low tack adhesive, hook and loop type fasteners, or if made from polymeric film by electrostatic adhesion. With this configuration, different cards or overlays 253 can be sent, received and used in connection with a single device 12. The cards and overlays 253 can also be used in connection with the device 12 without any other support or structure such as the base 251, or with other types of bases such as that shown in FIG. 4.

Figure 27:
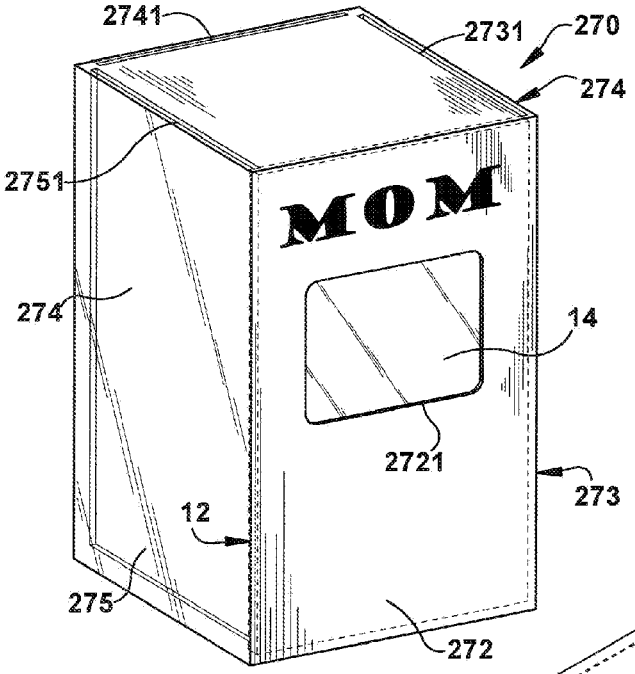
FIG. 27 is a perspective view of a thirteenth representative embodiment of an electronic greeting card of the disclosure.

FIG. 27 illustrates an electronic greeting card 270 which is generally cubic, with a substantially rigid cubic structure 271 in which the device 12 is held proximate to one of the walls of the cube 271, such as wall 272 which includes an opening 2721 through which the display 14 is visible. One or more of the other walls 273, 274, 275, if transparent, are optionally configured with respective slots 2731, 2741, 2751 in which artwork, signs or photographs can be inserted for display in combination with the multimedia play by the device 12.

Figure 28:
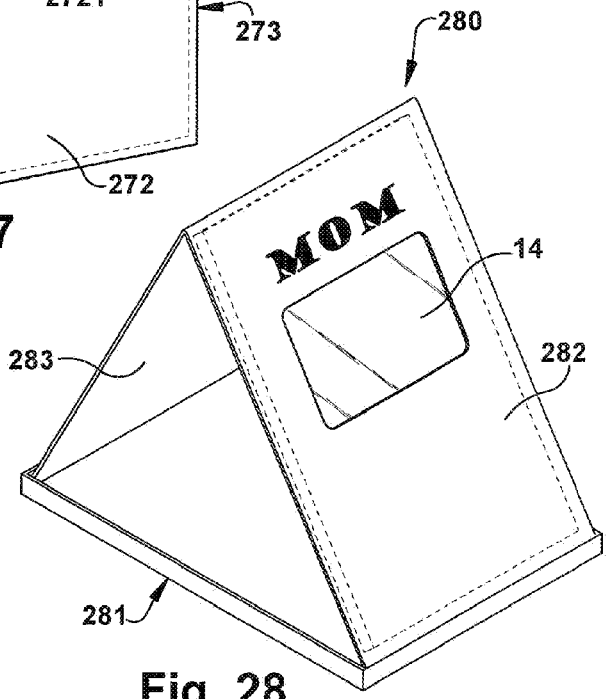
FIGS. 28-30 are perspective and side views of a fourteenth representative embodiment of an electronic greeting card of the disclosure, and FIGS. 31 and 32 schematically illustrate first and second embodiments circuitry and component designs for the multimedia player of the electronic greeting card of the disclosure.
Figure 29:
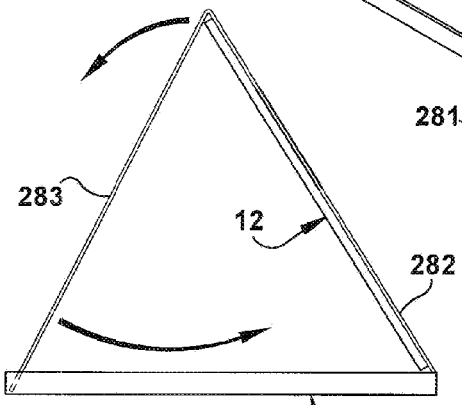

FIGS. 28-30 illustrate an electronic greeting card 280 in which the device 12 is held in a base or tray 281, from which extends a first panel 282 which extends over a front cover 121 of the device 12, and a second panel 283 which extends over the back cover 122 in the packaged or folded configuration shown in FIG. 30. This provides a protective enclosure and package for the device 12 for shipment and merchandising, with an integral display configuration which is easily erected. In accordance with this general configuration and embodiment, the first and second panels of the card are connected together along a fold line which is located at a top edge of one of the panels, and which is proximate to a top edge of the case of the device 12. The panel so attached may be flipped up or opened/closed in either direction.

Figure 33:
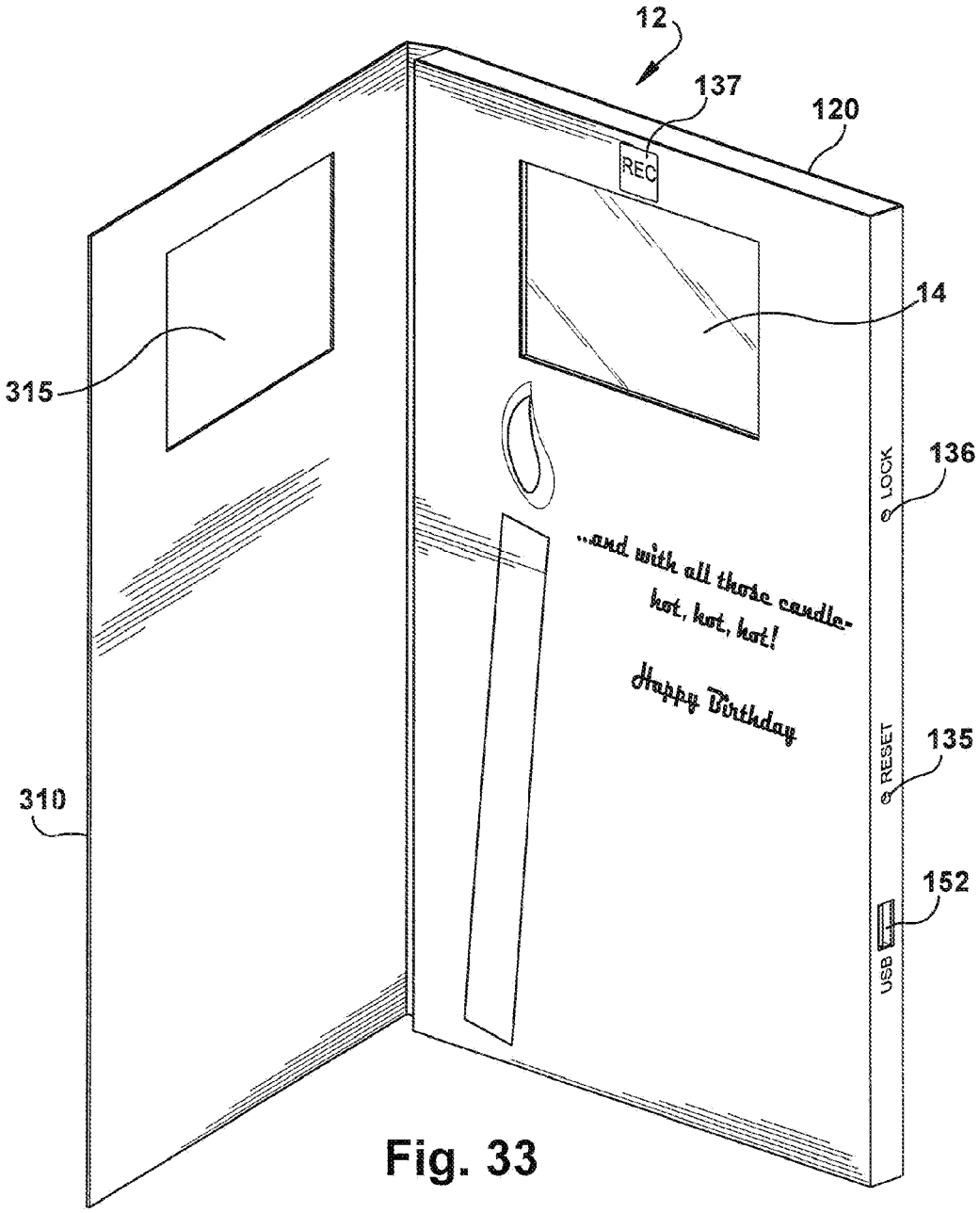
FIGS. 33 and 34 are perspective views of an alternate embodiment of the electronic greeting card of the present invention.
Figure 34:
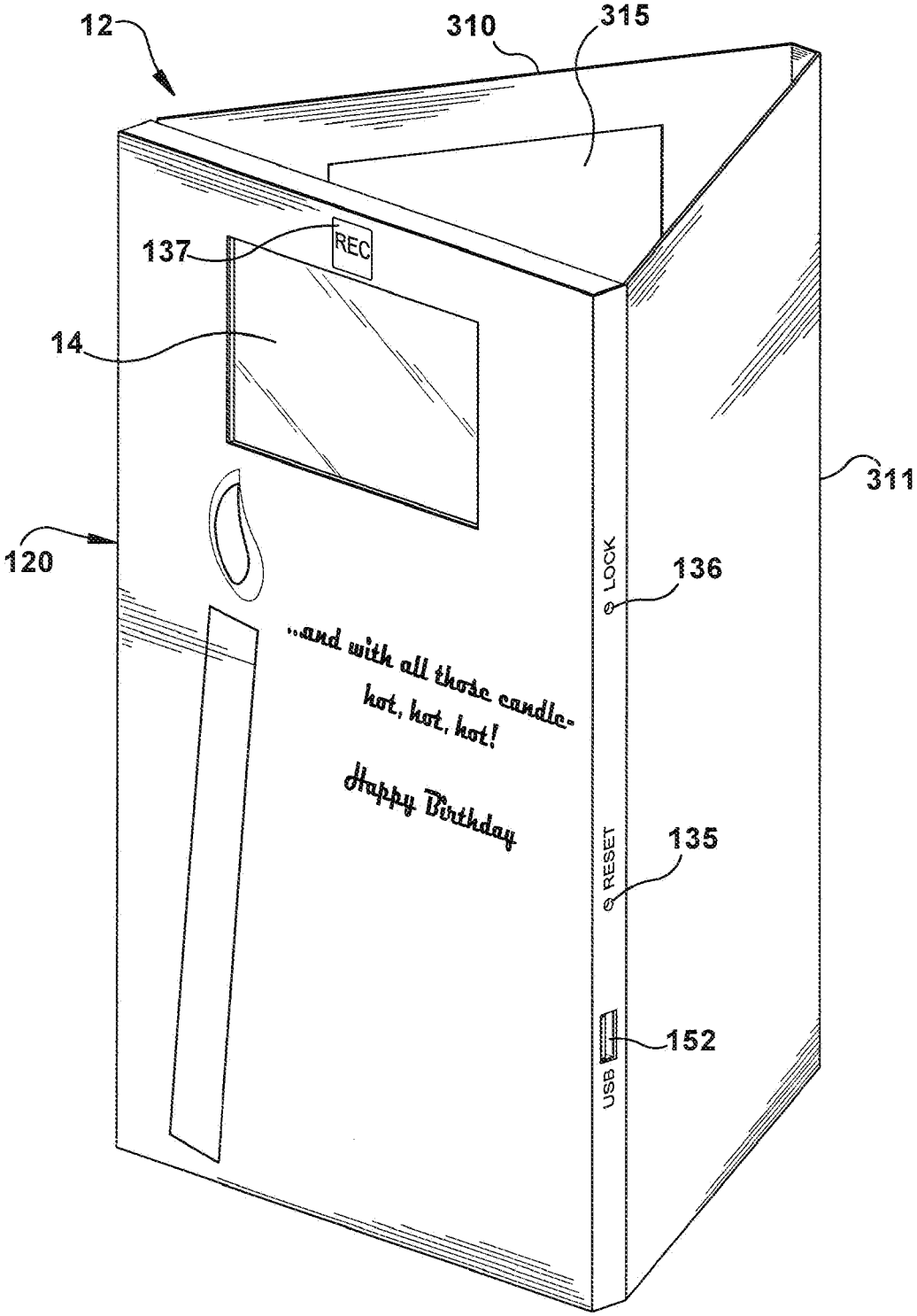

Another embodiment of the electronic greeting card of the present invention and related disclosure is shown in FIG. 33. In this embodiment, the multimedia player device 12 is combined with a greeting card which includes multiple panels that fit around the device 12. The greeting card contains a first panel 310 having a first side which serves as the first or cover page and a second side which serves as a second page of the greeting card. The first panel 310 contains an opening 315 thereon that corresponds in shape, size and location with the opening contained within the device case 120 through which the LCD screen 14 is visible. The first side of the first panel 310 may contain artwork, graphics and/or text sentiment. The first panel 310 is connected along a first fold line to a side tab panel that corresponds in length and width to the perimeter walls of the device case about which the greeting card is wrapped. The side tab panel is connected along a second fold line to a second panel 311 having a first side and a second side. The second panel 311 is connected along a third fold line to the portion of the greeting card that is wrapped around the multimedia player device 12. The second side of the second panel 311 is concealed behind the device case 120 until and unless the user unfolds all panels of the greeting card to display the electronic greeting card in an upstanding, triangular fashion, as shown in FIG. 34. Prior to a user unfolding the greeting card panels to place the device in a standing position, the device serves as the inside right panel or second page of the greeting card.

The multimedia player device 12 is operative to display and play, with images and audio, multimedia content including graphics, photographs, video and sound and music. The device 12 is operative to provide pre-loaded content but also supports user supplied content via a USB port 152 contained within the device and preferably accessed through the perimeter of the case. The device is capable of storing up to approximately 50 digital photographs and presenting them in a slideshow format wherein consecutive photographs are displayed on a loop. Instrumental music may be pre-loaded on the device and configured to play upon initiation of the slideshow. The device additionally includes digital recording device that allows for digital recording and playback of a user's personalized audio message. A record button 137 is located above the LCD display 14. It is concealed beneath the paperboard or greeting card material which is wrapped around the case and indicated as such by a removable sticker or other such removable identifying device. When a user presses and releases the record button 137, a prompt timer will appear on the display screen 14. When prompted, the user may begin recording a personal message for the recipient. To end the recording session, the user must again press and release the record button 137. The screen 14 will indicate "saving recording". The recording may last for up to 5 minutes. The user may re-record the message as many times as necessary by repeating the above steps. When the user is satisfied with the greeting, he/she may use the lock feature to "lock" the recording or prevent re-recording a message over the existing message. To lock a message the user must press the lock button 136, preferably located and accessed through the perimeter of the case. To "unlock" a recording, the user must simply press the lock button 136 again. When the lock button has been pressed, the display will indicate either "locked" or "unlocked" to notify the user the status of the current message. A "reset" button 135, also preferably located and accessed through the perimeter of the case, is used to "reboot" or reset the electronics in situations where the multimedia slideshow slows down, freezes, or shows other signs of a malfunction. Pressing the reset button 135 will not erase any of the content stored on the card's memory storage device, including voice recordings, photographs or music. A magnetic switch is used to initiate both the multi-media presentation (slideshow) and the audio message upon the opening of the greeting card. Magnets are inserted within the first panel of the greeting card and also between the device case and greeting card overlay on what appears to be the second page of the greeting card. When the greeting card is closed (when the first panel of the greeting card is positioned directly atop the device case or second page of the greeting card) the switch is open. Once the magnets are separated by opening the first panel of the greeting card, the switch closes, thus initiating the slideshow and personalized audio message. Although a magnetic switch has been described, other types of switches such as light or touch sensitive switches or a slide switch may also be used and are within the scope of the invention and related disclosure.

Figure 35:
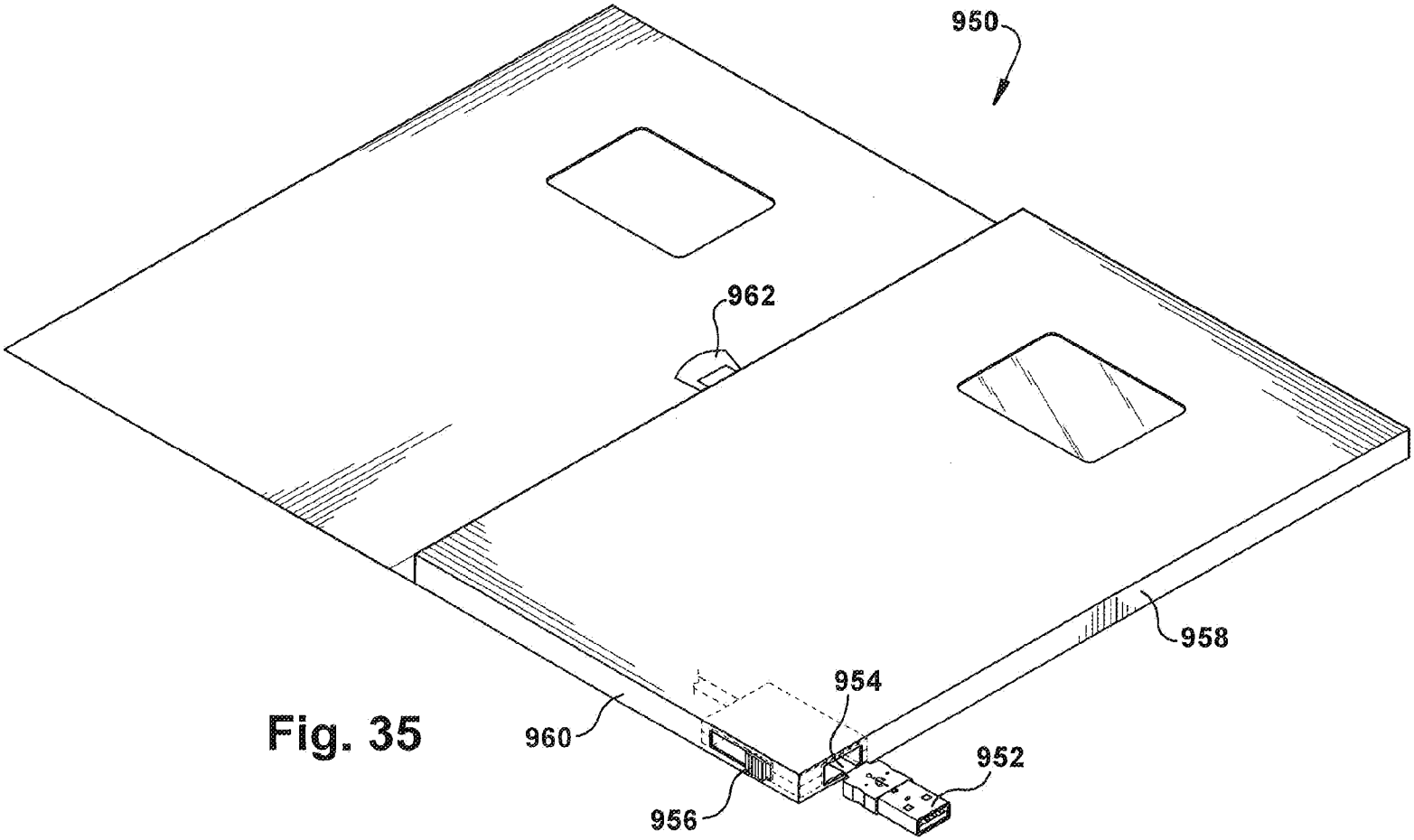
FIG. 35 is a perspective view of an alternate embodiment of the electronic greeting card of the present invention with a slide-out USB port and cable.
Figure 43:
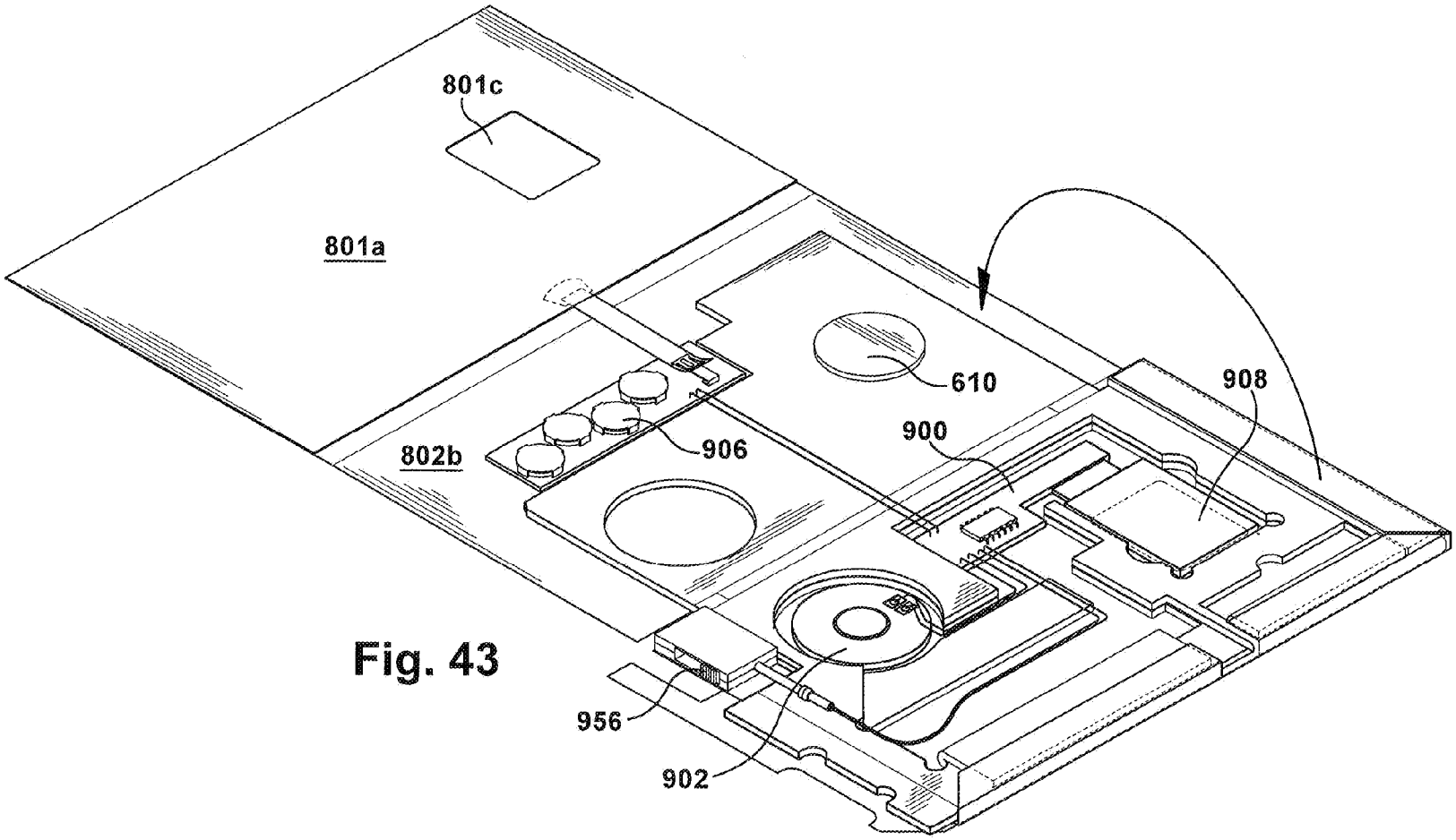
FIG. 43 is the fully assembled electronic greeting card of FIGS. 36-39.

In another alternate embodiment, the electronic greeting card includes a slide-out USB port with retractable cord, as shown in FIG. 35. A slide lever 956 is accessible through an opening in a first perimeter wall of the multimedia display case. Moving the slide lever 956 to the right ejects the USB port 952 and cable 954 out through another opening in a second perimeter wall of the case. The cable 954 extends out approximately one inch from the greeting card. In a representative embodiment, the slide lever 956 is located on the bottom perimeter wall 960 of the display case, proximate to the right perimeter wall 958 and the opening for the USB port 952 is located on the lower portion of the right perimeter wall 958 proximate to the bottom perimeter wall 960. When the slide lever 956 is moved back to the left, the USB port 952 and cable 954 are retracted or re0inserted into a cavity in the multimedia display case. Therefore, when the USB cable 952 is not in use, it can be stored within the device case and when the USB port 952 is needed it can easily be removed from the case. The USB cable 954 allows for easier connection of the USB port 952 to a USB slot located on an electronic device such as a personal computer. The slide0ot USB port 952 can be used along with any of the embodiments of the electronic greeting card described herein. For example, the slide-out USB port 952 and cable 954 may be used with an electronic greeting card having various control switches accessible through the perimeter wall of the multimedia display case, such as an on/off switch, a lock button, a reset button, or any other appropriate control devices. The slide-out USB port 952 and cable 954 may also be used with an electronic greeting card having no other controls located along the perimeter of the display case, such as the embodiment shown in FIG. 43, and described below. The multimedia display device may be triggered a slide switch 962 which automatically activates the device upon opening of the greeting card 950. Other switches such as a magnetic switch, described above, or a light sensitive switch, a touch sensitive switch, a sound-activated switch, or any other such switches that are known in the art, may be sued to initiate playback of the multimedia files stored within the multimedia device.

Figure 36:
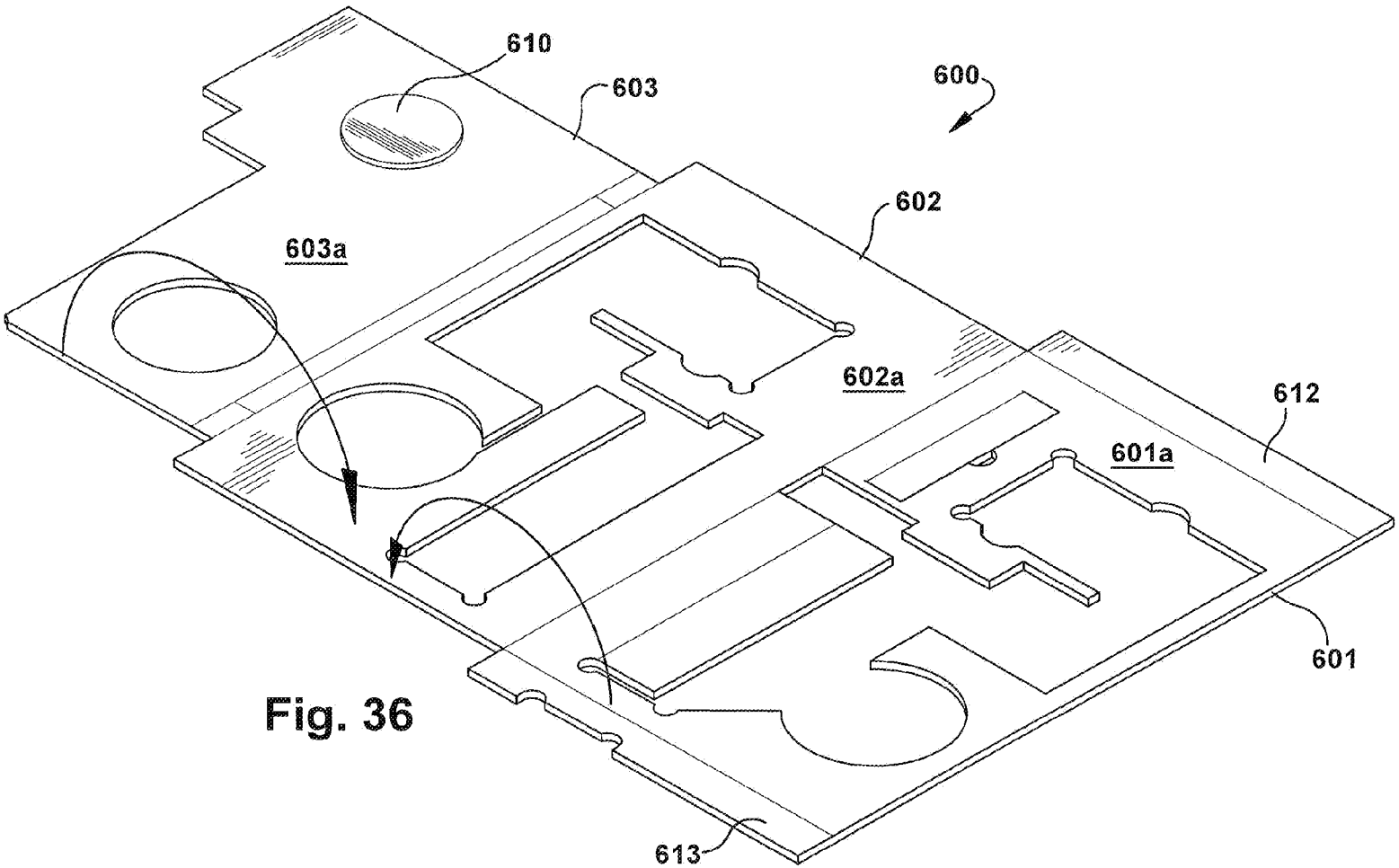
FIGS. 36-39 are perspective views of the greeting card insert in various stages of assembly.
Figure 37:
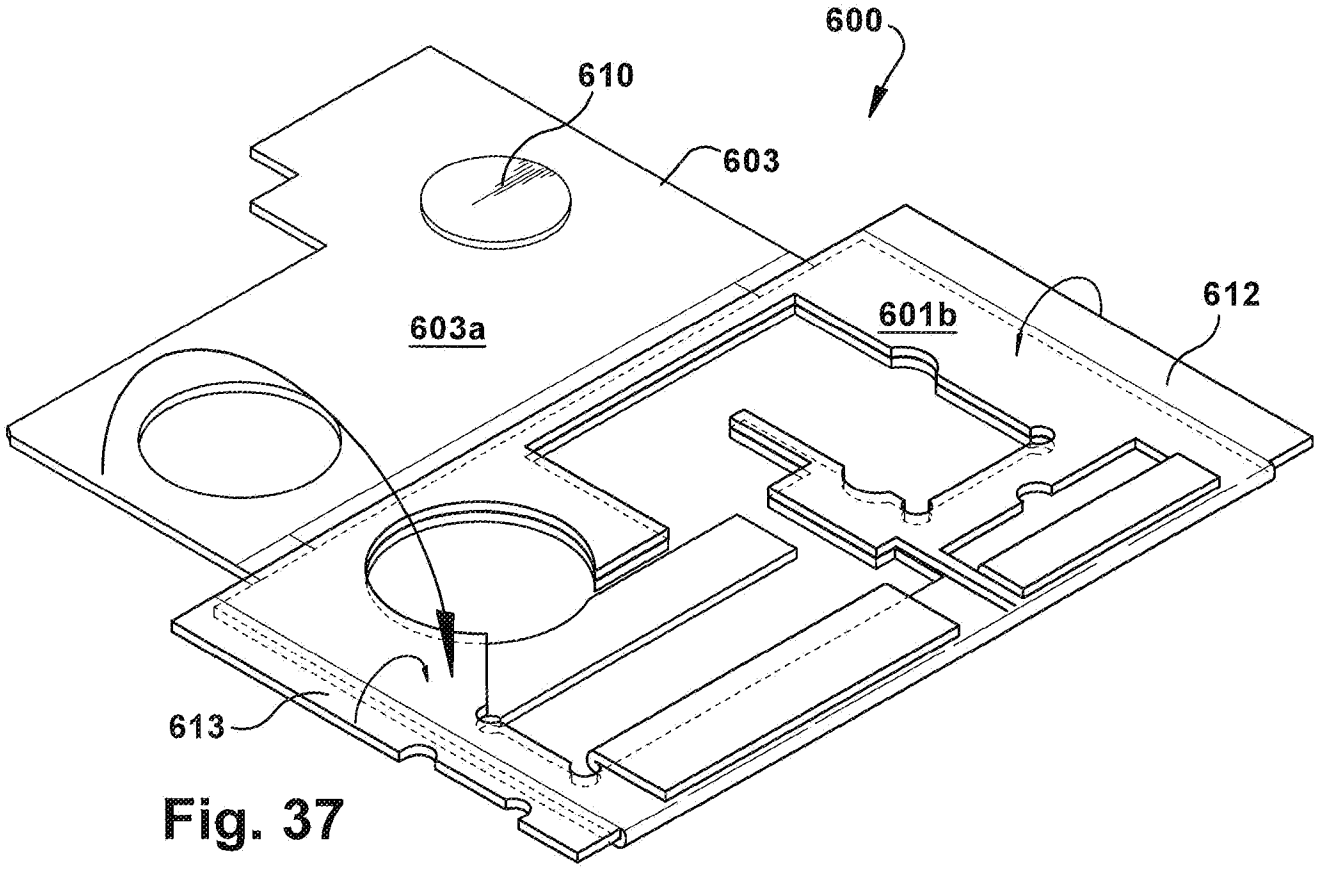
Figure 38:
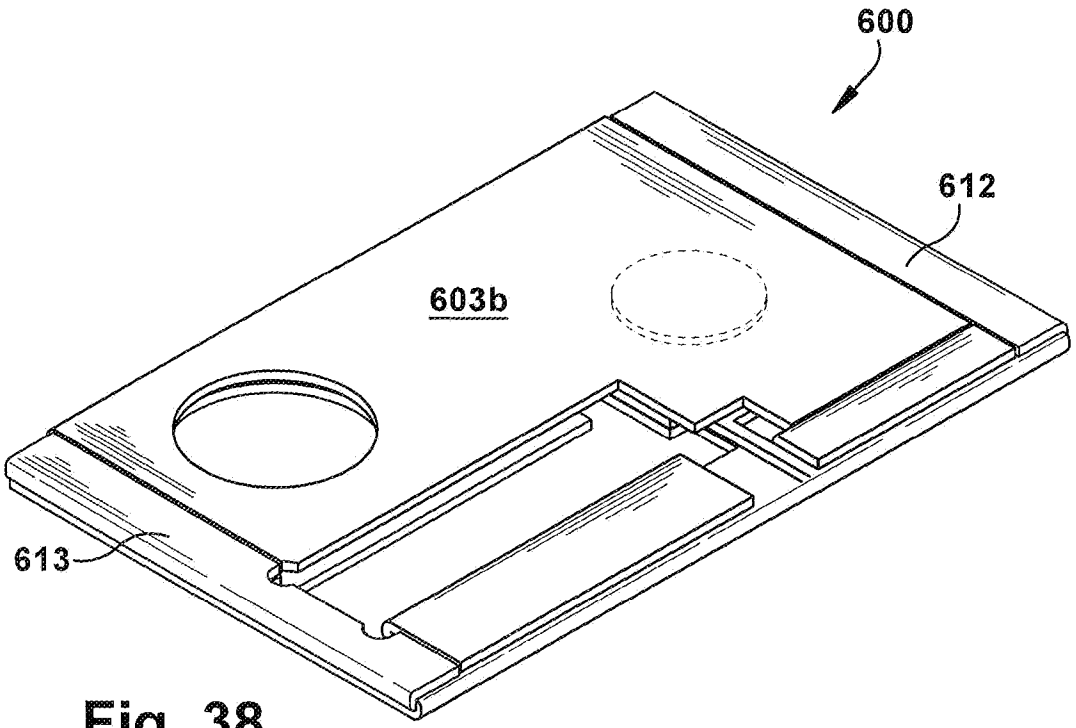
Figure 42:
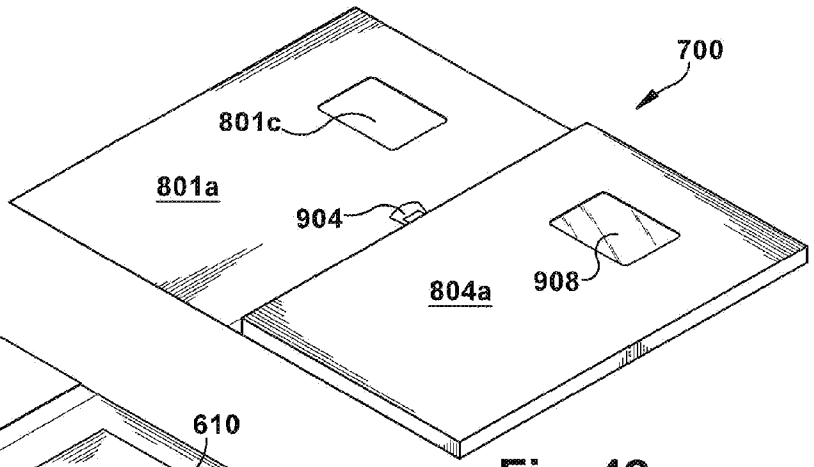
FIGS. 41 and 42 are perspective views of the greeting card insert, greeting card body, and multimedia device components.

In still another embodiment, shown in FIG. 42, the multimedia greeting card 700 is a streamlined, disposable version having a multimedia player device encased in a protective insert preferably corrugated fiberboard (hereinafter referred to as "corrugate"). The electronic greeting card 700 can be constructed without a hard shell or plastic case or enclosure. Corrugate, which is typically made of paperboard or other durable paper-like material which is relatively inexpensive and easily customized. It is comprised of a multi-arched sheet having rows of arches or flutes that are sandwiched between two flat sheets or liners. The protective insert 600, shown in FIGS. 36-40, is customized such that each component of the multimedia player device is encased in or substantially surrounded by corrugate. The insert 600 provides strength and durability so that the multimedia components are not injured during shipping, mailing or otherwise. The insert 600 may be one integral piece of corrugate which is strategically bent or folded or it may be two or more separate pieces of corrugate which are in a stacked arrangement contained within the panels of a greeting card. Alternatively, the insert 600 may be constructed of layers of material such as paper or fibers or foam or any other material which can be configured scribed herein. In a representative embodiment, shown in FIG. 36, the insert 600 includes three panels 601-603, each panel having a front surface 601*a*, 602*a*, 603*a* and a back surface 601*b*, 602*b*, 603*b* and various cutout portions thereon. As shown in FIG. 36, the front surface of each panel is in an upward facing position. The first 601 and second 602 panels contain distinct openings or cut-outs for the display screen, the circuit board, the speaker and the power source or batteries. As shown in FIGS. 36 and 37, the first panel 601 is folded over of placed on top of the second panel 602 such that the front surface 602*a* of the second panel 602 is in direct contact with the front surface 601*a* of the first panel 601. The first 601 and second 602 panels provide the card with a thickness or depth such that the display screen, circuit board and batteries are either flush with or sunken in or at a lower elevation than the stacked first 601 and second 602 panels. It contains an opening for the speaker but otherwise covers and protects the display screen and circuit board. The third panel 603 also contains a thin pad or cushion 610 that provides a cushion or extra protection for the display screen. The third panel 603 is folded or placed over the stacked first 601 and second 602 panels such that the front surface 603*a* of the third panel 603 is in direct contact with the back surface 601*b* of the first panel 601, as shown in FIGS. 37 and 38. The first panel 601 additionally contains an upper 612 and lower 613 tab that are folded over onto the first panel 601 such that the back surface of the upper 612 and lower 613 tabs is in direct contact with the back surface 601*b* of the first panel 601, as shown in FIGS. 37 and 38. Once the three corrugate panels 601, 602, 603 are secured in a stacked arrangement an opening remains so that the top surface of the speaker is not covered by the protective insert 600 to allow for better sound projection. An area for the batteries and slide switch also remains uncovered by insert 600. Each multimedia component is substantially surrounded and therefore protected by the protective insert 600. The insert 600 is then enclosed and concealed within the body of the greeting card.

Figure 39:
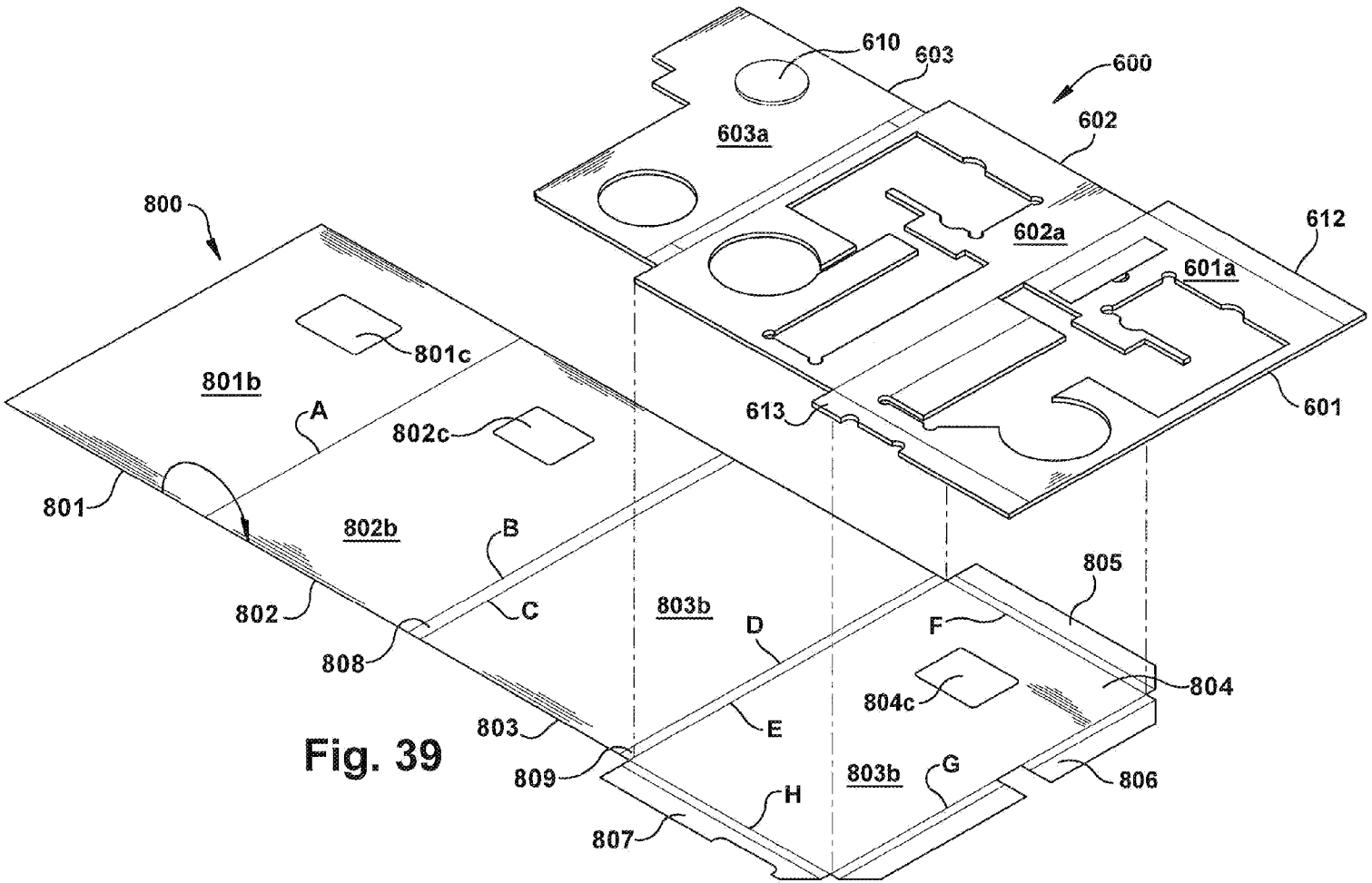
Figure 40:
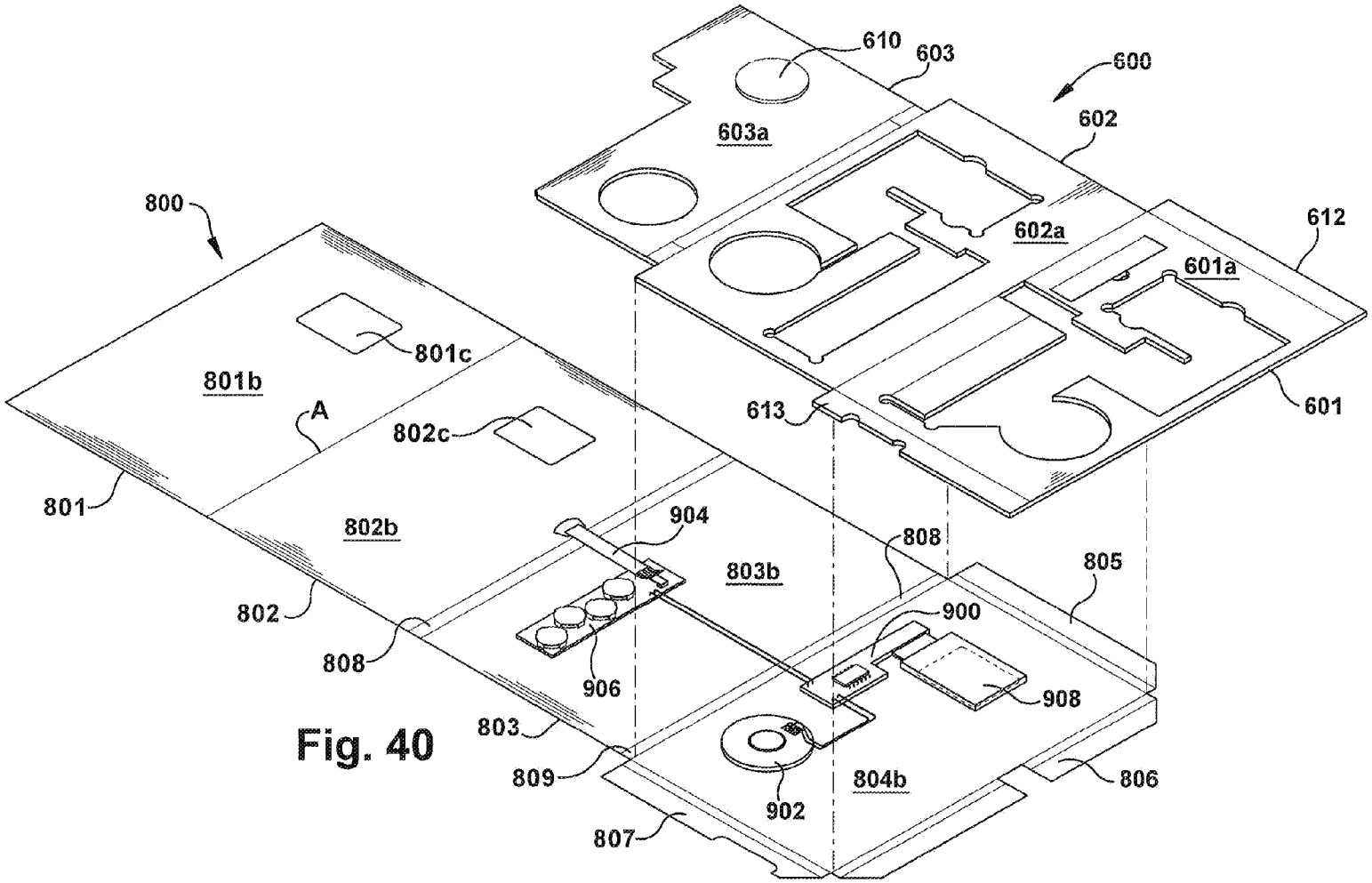
FIG. 40 is a perspective view of the greeting card insert and greeting card body.
Figure 41:
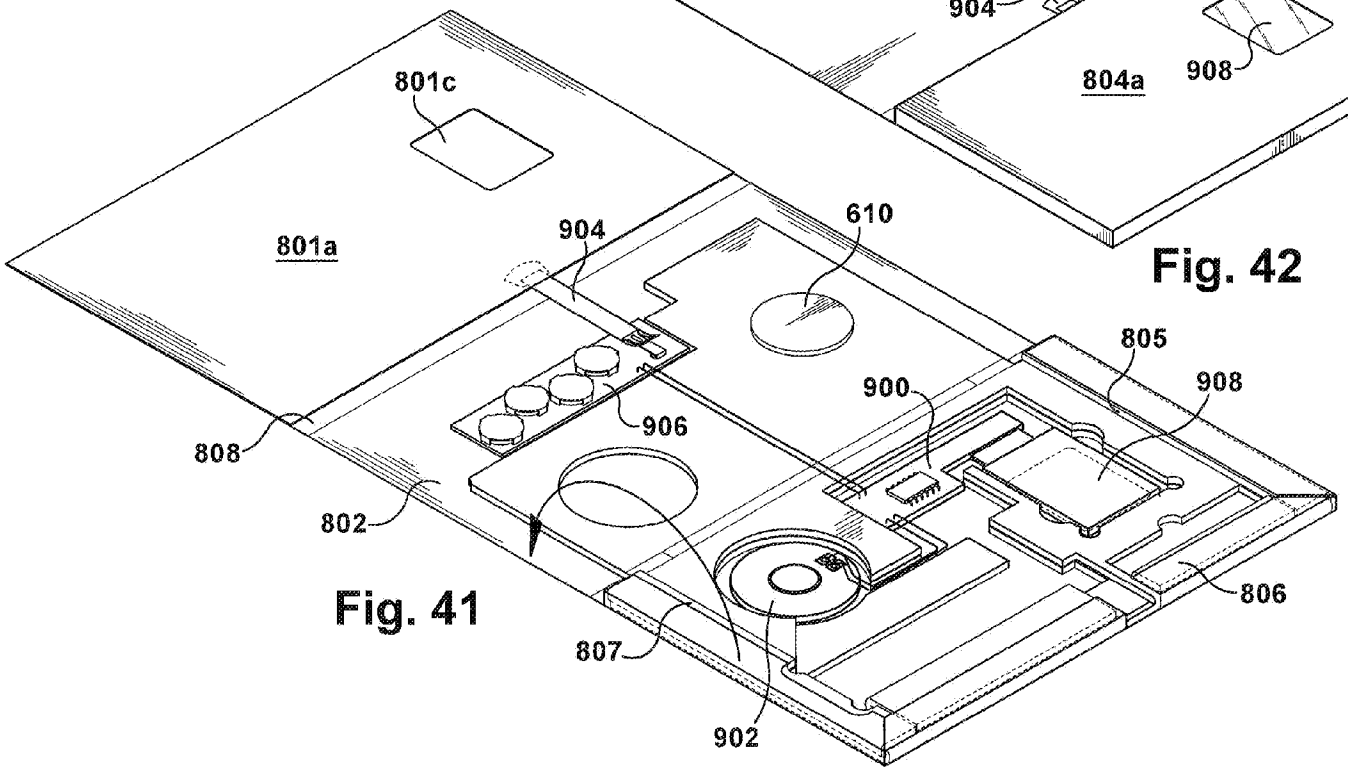

The greeting card body 800 is much like the greeting card described above with respect to FIG. 34, the greeting card body 800 having a multi-panel construction which wraps around the multimedia device components. As shown in FIGS. 39-41, four main greeting card panels 801 802, 803, 804 and two side tab panels 808, 809 are connected along various fold lines to wrap around the protective insert 600 that is used to encase and protect the multimedia device components. Each panel 801, 802, 803, 804 contains a front surface 801*a*, 802*a*, 803*a*, 804*a* and a back surface 801*b*, 802*b*, 803*b*, 804*b*. The first panel 801 folds over fold line A and is attached to the second panel 802, with the back surface 801*b* of the first panel 801 in direct contact with the back surface 802*b* of the second panel 802. The front surface 801*a* of the first panel serves as the left inside panel of the greeting card and the front surface 802*a* of the second panel 802 serves as front or cover pages of the greeting card. The front surfaces 801*a*, 802*a* of the first 801 and second 802 panels may contain artwork, graphics and/or text sentiment. The first 801 and second 802 panels may also contain an opening 801*c*, 802*c* thereon through which a display screen is visible. The second panel 802 is connected to a first side tab panel 808 along fold line B. The first side tab panel 808 is connected along a third fold line C to the third panel 803. The front surface 803*a* of the third panel 803 serves as the back or last page of the greeting card. The back surface 803*b* of the third panel 803 is in direct contact with the protective insert 600. The third panel 803 is connected to a second side tab panel 809 along fold line D and the second side tab panel is connected to the fourth panel 804 along fold line E. The front surface 804*a* of the fourth panel 804 serves as the inside right panel of the greeting card, having an opening 804*c* thereon through which a display screen is visible. Both of the side tab panels 808, 809 approximately correspond in length and width to the protective insert 600 which surrounds and protects the multimedia device components. Three tabs 805, 806, 807 are connected to each free edge of the fourth panel 804. Side tab 805 is connected to the fourth panel 804 along fold line F; side tab 806 is connected to the fourth panel 804 along fold line G and side tab 807 is connected to the fourth panel 804 along fold line H. The third 803 and fourth 804 panels, the first 808 and second 809 side tabs, and the three tabs 805, 806, 807 connected to the fourth panel 8094 operate to cover the protective insert 600 and multimedia device components. The protective insert 600 and multimedia device components are contained and concealed within the cavity created by the third 803 and fourth 804 panels, first 808 and second 809 side tab panels and tabs 805, 806, 807. The protective insert 600 is attached, adhesively or otherwise to the back surface 803*b*, 804*b* of the third 803 and fourth 804 panels of the greeting card body 800. The fourth panel 804 is then folded over the third panel 803 along fold lines C and D and side tabs 805, 806 and 807 are folded down and secured to the top, the left side and the bottom edges of the protective insert 600.

The multimedia player device components may include a display screen 908, a circuit board 900, an integrated circuit, a microprocessor, a memory device for digital data storage, an audio speaker 902, switch mechanism 904, a power source 906 and related circuitry. One or more pre-loaded image and/or sound files are stored on the memory device. The power source 906 is preferably lithium batteries. The multimedia device components may be attached directly to the back surface 803*b*, 804*b* of the third 803 and fourth 804 panel (as shown in FIG. 40) or they may be attached to a secondary substrate that is placed between the third 803 and/or fourth panel 804 and the protective insert 600.

In the representative embodiment, the multimedia player device is triggered by a slide switch 904 which automatically activates the device upon opening of the greeting card. The slide switch 904 is located between first side tab 808 and the third greeting card panel 803. When a use opens the greeting car or moves the first 801 and second 802 greeting card panels outward and away from the third 803 and fourth 804 greeting card panels, the slide switch 904 is triggered, which initiates playback of visual content on the display screen 908 and audio content through the speaker 902. Other switches such as a magnetic switch, a light sensitive switch, a touch sensitive switch, a sound-activated switch, or any other such switches that are known in the art, may be used to initiate playback of the multimedia files stored within the multimedia device.

In one embodiment, the multimedia player device is operative to play pre-loaded sound and digital images and/or photographs. The digital images and/or photographs are displayed in a slideshow arrangement, one after another. Sound such as background music may also be initiated by the slide switch and played during the slideshow. In another embodiment, the device is operative to also play pre-loaded digital video files. In both cases, the device is also operative to emit sound, which may or may not be synchronized with the pre-loaded digital images or video.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

The invention claimed is:

1. An electronic greeting card comprising;

a multimedia player device comprising a circuit board with microprocessor; and electronic display operative to display still images or video; a speaker operative to generate sound from digital data; a memory storage device;

a USB port;

circuitry which operatively connects the USB port with the electronic display and speaker to process digital multimedia data located on an external device connected to the USB port for display of static or moving images on the electronic display and audible emission of audio through the speaker;

a switch operative to initiate display of static or moving images on the electronic display and/or audible emission of audio through the speaker; and a multi-panel greeting card body which surrounds the multimedia player device with at least two openings thereon through which the electronic display is visible.

2. The electronic greeting card of claim 1, wherein the memory storage device contains one or more pre-loaded digital data files.

3. The electronic greeting card of claim 1, wherein the USB port is located in a perimeter wall of the greeting card.

4. The electronic greeting card of claim 1, wherein a multi-layered protective insert surrounds the multimedia player device beneath the multi-panel greeting card body.

5. The electronic greeting card of claim 1 further comprising an SD card slot.

6. The electronic greeting card of claim 1, wherein the switch initiates display of pre-loaded static or moving images on the display screen when no external data has been uploaded to the memory device via the USB port.

7. An electronic greeting card comprising:

a multi-panel greeting card body;

a circuit board and microprocessor;

an electronic display screen operative to display still images or video;

a digital data storage device operative to store one or more digital data files;

a power source;

a switch operative to initiate playback of still images or video on the electronic display;

a port operative to accept the insertion of an external memory device for uploading digital data from an external source to the digital data storage device, wherein the multi-panel greeting card body contains two openings thereon through which the display screen is visible.

8. The electronic greeting card of claim 7 further comprising a speaker.

9. The electronic greeting card of claim 8, wherein the switch is also operative to initiate playback of digital audio data through the speaker.

10. The electronic greeting card of claim 7, wherein the port is a USB port.

11. The electronic greeting card of claim 7, wherein the port is an SD card slot.

12. The electronic greeting card of claim 7 further comprising one or more pre-loaded digital data files saved on the digital data storage device.

13. The electronic greeting card of claim 7 further comprising one or more pre-loaded digital data files if no external data files are uploaded to the digital data storage device.

14. The electronic greeting card of claim 7 further comprising a protective insert located beneath the multi-panel greeting card body and surrounds the circuit board and microprocessor and the electronic display screen.

15. An electronic greeting card comprising:

a multimedia player device comprising a display screen, a circuit board with a microprocessor, a data storage device and a speaker;

a multi-panel greeting card which surrounds the multimedia player device, the multi-panel greeting card having at least one opening thereon through which the display screen is visible;

a USB port operative to connect an external device to the greeting card for the upload of digital data files to the data storage device; and a switch which controls the display of still images or video on the display screen and emission of digital sound data through the speaker, wherein the multi-panel greeting card contains two openings thereon through which the display screen is visible.

16. The electronic greeting card of claim 15, wherein if there are no uploaded still images, video or digital sound data, pre-loaded audio and video files are displayed on the display screen and emitted through the speaker.

17. The electronic greeting card of claim 15 further comprising an SD card slot.

18. The electronic greeting card of claim 15 further comprising a stack of layered corrugate which is covered by the multi-panel greeting card and which surrounds and protects the multimedia player device.

* * * * *